US008454798B2

(12) United States Patent
Ban et al.

(10) Patent No.: US 8,454,798 B2
(45) Date of Patent: Jun. 4, 2013

(54) PAPER MAKING PROCESSES AND SYSTEM USING ENZYME AND CATIONIC COAGULANT COMBINATION

(75) Inventors: Weiping Ban, Memphis, TN (US); Gary Headrick, Memphis, TN (US); Rosa M. Covarrubias, Memphis, TN (US)

(73) Assignee: Buckman Laboratories International, Inc., Memphis, TN (US)

( * ) Notice: Subject to any disclaimer, the term of this patent is extended or adjusted under 35 U.S.C. 154(b) by 0 days.

(21) Appl. No.: 13/086,889

(22) Filed: Apr. 14, 2011

(65) Prior Publication Data

US 2011/0253333 A1 Oct. 20, 2011

Related U.S. Application Data

(60) Provisional application No. 61/324,499, filed on Apr. 15, 2010.

(51) Int. Cl.

| | |
|---|---|
| ***D21H 23/14*** | (2006.01) |
| ***D21H 17/00*** | (2006.01) |
| ***D21H 17/28*** | (2006.01) |
| ***D21H 17/33*** | (2006.01) |
| ***D21H 17/45*** | (2006.01) |
| ***D21H 17/56*** | (2006.01) |
| ***D21H 17/66*** | (2006.01) |
| ***D21F 1/66*** | (2006.01) |

(52) U.S. Cl.

USPC ..... 162/183; 162/72; 162/164.1; 162/164.6; 162/168.2; 162/168.3; 162/158; 162/175; 162/181.2

(58) Field of Classification Search

USPC ..... 162/70, 72, 158, 164.1, 164.3, 164.6, 162/168.1–168.3, 175, 181.1–181.8, 183

See application file for complete search history.

(56) References Cited

U.S. PATENT DOCUMENTS

| | | | | |
|---|---|---|---|---|
| 2,915,475 | A | | 12/1959 | Bugosh |
| 3,041,246 | A | * | 6/1962 | Bolaski et al. ..... 435/278 |
| 3,406,089 | A | * | 10/1968 | Yerkes, Jr. ..... 162/199 |
| 4,421,602 | A | | 12/1983 | Brunnmueller et al. |
| 4,894,119 | A | * | 1/1990 | Baron et al. ..... 162/168.2 |
| 4,923,565 | A | | 5/1990 | Fuentes et al. |

(Continued)

FOREIGN PATENT DOCUMENTS

| | | | |
|---|---|---|---|
| DE | 4130919 | A1 * | 3/1992 |
| EP | 0860522 | A1 | 8/1998 |

(Continued)

OTHER PUBLICATIONS

Gigac et al., "Drainability, Permeability and Formation of RCF Pulps Blended with Sugar Beet Pulps," Appita Journal, 2009, 62(3), 208-211, 218. Abstract only.

(Continued)

*Primary Examiner* — Jose A Fortuna

(74) *Attorney, Agent, or Firm* — Kilyk & Bowersox, P.L.L.C.

(57) ABSTRACT

A method is described for making paper or paper board by applying a composition containing enzyme and cationic coagulant to papermaking pulp prior to paper forming to preferably improve drainage, retention, or both. Sheets of pulp from which paper or paperboard products are made with the method can exhibit excellent drainage, excellent retention of pulp fines, or both. The method also can be applied to other pulp treatments, such as waste water treatments. A system for making such treatments of paper furnish is also provided.

15 Claims, 12 Drawing Sheets

U.S. PATENT DOCUMENTS

| | | | | |
|---|---|---|---|---|
| 5,110,412 | A * | 5/1992 | Fuentes et al. | 162/5 |
| 5,169,497 | A | 12/1992 | Sarkar et al. | |
| 5,185,461 | A | 2/1993 | Tanaka et al. | |
| 5,308,449 | A * | 5/1994 | Fuentes et al. | 162/72 |
| 5,356,800 | A | 10/1994 | Jaquess | |
| 5,423,946 | A * | 6/1995 | Sarkar et al. | 162/158 |
| 5,501,770 | A * | 3/1996 | Sarkar et al. | 162/100 |
| 5,507,914 | A | 4/1996 | Sarkar et al. | |
| 5,582,681 | A * | 12/1996 | Back et al. | 162/5 |
| 5,620,565 | A * | 4/1997 | Lazorisak et al. | 162/72 |
| 5,865,949 | A * | 2/1999 | Pere et al. | 162/24 |
| 6,027,610 | A * | 2/2000 | Back et al. | 162/111 |
| 6,099,688 | A * | 8/2000 | Pere et al. | 162/24 |
| 6,273,998 | B1 * | 8/2001 | Kuo et al. | 162/168.2 |
| 6,712,933 | B2 | 3/2004 | Karve et al. | |
| 6,770,170 | B2 | 8/2004 | Covarrubias | |
| 6,939,437 | B1 * | 9/2005 | Hill et al. | 162/9 |
| 2002/0033245 | A1 * | 3/2002 | Karve et al. | 162/181.5 |
| 2002/0100568 | A1 | 8/2002 | Covarrubias | |
| 2002/0144951 | A1 * | 10/2002 | Sarkar et al. | 210/730 |
| 2005/0161183 | A1 * | 7/2005 | Covarrubias | 162/158 |
| 2007/0169903 | A1 * | 7/2007 | Covarrubias et al. | 162/158 |
| 2007/0261806 | A1 * | 11/2007 | Wang et al. | 162/32 |
| 2009/0263563 | A1 | 10/2009 | Tanaka et al. | |
| 2009/0314446 | A1 | 12/2009 | Lu et al. | |
| 2010/0170646 | A1 * | 7/2010 | Wang et al. | 162/74 |
| 2010/0269989 | A1 * | 10/2010 | Wang et al. | 162/5 |
| 2011/0253333 | A1 * | 10/2011 | Ban et al. | 162/164.6 |
| 2011/0290434 | A1 * | 12/2011 | Jehn-Rendu et al. | 162/4 |
| 2012/0227920 | A1 * | 9/2012 | Juppo et al. | 162/164.6 |
| 2012/0241114 | A1 * | 9/2012 | Axrup et al. | 162/127 |

FOREIGN PATENT DOCUMENTS

| | | | |
|---|---|---|---|
| JP | 2001-269328 | A | 10/2001 |
| JP | 2003-52326 | A | 2/2003 |
| WO | 94/26972 | A1 | 11/1994 |
| WO | 97/41063 | A1 | 11/1997 |
| WO | 99/43780 | A1 | 9/1999 |
| WO | WO 01/36740 | A2 | 5/2001 |

OTHER PUBLICATIONS

Sherman et al., "On-Machine Efficiency Through Enzymatic Control of Wet-End Contaminants," 17th PTS CHT Symposium: Chemical Technology of Papermaking, Sep. 12-15, 2006, Paper 16, 14 pages. Abstract only.

Ricard et al., "Pectinase Reduces the Cationic Demand of Peroxide-Bleached TMP: A Paper-Machine Trial," Annual Meeting, Pulp and Paper Technical Association of Canada, Jan. 27-29, 2004, A261-A270. Abstract only.

Caram et al., "Paper Mill Evaluation of a Cellulolytic Enzyme and Polymers for Improving the Properties of Waste Paper Pulp," Papermakers Conference, Mar. 24-27, 1996, 481-498. Abstract only.

Pruszynski, P. "Achieving Process Control and Stability," Wet End and Water Systems Management for Papermakers, Dec. 14-15, 2006, 22 pages. Abstract only.

Wilkinson et al., "Mechanisms of Incorporation and Release of Enzymes into Cheese During Ripening," International Dairy Journal, 2005, 15(6-9), 817-830. Abstract only.

Wada et al., "Removal of Phenols and Aromatic Amines from Wastewater by a Combination Treatment with Tyrosinase and a Coagulant," Biotechnology and Bioengineering, 1995, 45(4), 304-9. Abstract only.

Posada et al., "Practical Approach on Protein Stabilizers," Proceedings of the Congress—European Brewery Convention, 1971, 14, 379-91. Abstract only.

International Search Report and Written Opinion issued in corresponding International Patent Application No. PCT/US2011/032475 mailed Dec. 20, 2011 (9 pages).

* cited by examiner

PAPER MAKING PROCESSES AND SYSTEM USING ENZYME AND CATIONIC COAGULANT COMBINATION

This application claims the benefit under 35 U.S.C. §119 (e) of prior U.S. Provisional Patent Application No. 61/324,499, filed Apr. 15, 2010, which is incorporated in its entirety by reference herein.

BACKGROUND OF THE INVENTION

The present invention relates to paper making processes and system for the processes. More particularly, the present invention relates to a paper making process and system using an enzyme and cationic coagulant combination to improve cellulosic pulp drainage and/or retention.

Conventional paper making processes generally include the following steps: (1) forming an aqueous suspension of cellulosic fibers, commonly known as pulp; (2) adding various processing and paper enhancing materials, such as strengthening, retention, drainage aid and/or sizing materials, or other functional additives; (3) sheeting and drying the fibers to form a desired cellulosic web; and (4) post-treating the web to provide various desired characteristics to the resulting paper, such as surface application of sizing materials, and the like. Some cellulase enzymes can be used to treat cellulosic fiber and improve the drainage of the fiber suspension slurry. However, enzyme usage has required an additional pretreatment process of heating the cellulosic pulp, such as preheating the pulp to approximately 50° C. for about 30-120 minutes before enzyme addition. Additional energy consumption and equipment installation is required for such preheating operations for enzyme usage. Further, enzymes can be costly, and enzyme application for papermaking would result in significant increases in production cost.

The present investigators have seen a need for additives useful in papermaking processing that can produce paper with improved cellulosic pulp drainage and retention in cost reduced manners.

SUMMARY OF THE INVENTION

A feature of the present invention is to provide a papermaking method with improved cellulosic pulp drainage and/or retention.

Another feature of the present invention is to provide a papermaking method using enzymes without requiring preheating treatments of the pulp to obtain improved cellulosic pulp drainage and retention.

An additional feature of the present invention is to provide a papermaking system operable for using enzymes without requiring pulp preheating equipment to obtain improved cellulosic pulp drainage and/or retention.

Additional features and advantages of the present invention will be set forth in part in the description which follows, and in part will be apparent from the description, or may be learned by practice of the present invention. The objectives and other advantages of the present invention will be realized and obtained by means of the elements and combinations particularly pointed out in the written description and appended claims.

To achieve these and other advantages and in accordance with the purposes of the present invention, as embodied and broadly described herein, the present invention relates to a method of making paper or paperboard. The method includes applying a composition containing at least one enzyme and at least one cationic coagulant to a paper making pulp to form a treated pulp. The enzyme and cationic coagulant can be applied to a paper making pulp at the same time as a premixture or as separately added components. The enzyme and cationic coagulant, as another option, can be added sequentially within a short enough period of time to permit the components to interact in combination with the pulp. The treated pulp may also be further treated with at least one flocculant. The resulting treated pulp is then formed into a sheet of pulp, which can have improved drainage and/or retention properties compared to conventional treatments that do not use a composition having the enzyme and cationic coagulant combination.

The present invention also relates to a papermaking system for carrying out methods, such as above-described. The system can include a supply of papermaking pulp, a processing unit for forming the pulp into a paper or paperboard having at least a screen for collecting pulp and a paper sheet forming processing unit receiving pulp from the screen, a supply of a composition containing at least an aqueous dispersion of at least one enzyme and at least one cationic coagulant and a feeding device for feeding the composition to the pulp for application thereto prior to paper forming, and a supply of at least one flocculant and a feeding device for feeding the flocculant to the treated pulp downstream of where the enzyme and cationic coagulant composition is applied to the pulp, and a white water silo for white water recirculation.

Although illustrated for papermaking processing, the use of the enzyme and cationic coagulant combination also can relate to its application for other cellulosic fiber contained material for enhanced dewatering in various other industries, such as waste water treatments. The present invention can relate, for example, to a method of treating cellulosic pulp comprising applying a composition comprising enzyme and cationic coagulant to a cellulosic pulp dispersed or otherwise contained in a liquid medium to form a treated pulp, and optionally dewatering the treated pulp.

It is to be understood that both the foregoing general description and the following detailed description are exemplary and explanatory only and are only intended to provide a further explanation of the present invention, as claimed.

As used herein, "coagulant" refers to a material that can create larger particles by neutralizing electrical charges surrounding small particles in solution, e.g., neutralize repulsive electrical charges (e.g., negative charges) surrounding particles, allowing them to "stick together" creating clumps or flocs.

"Flocculant" refers to a material that can facilitate the agglomeration or aggregation of the coagulated particles to form larger floccules.

"Enzyme" refers to a material comprising a protein or conjugated protein functionable as a biochemical catalyst.

The accompanying drawings, which are incorporated in and constitute a part of this application, illustrate several aspects of the present invention and together with the description, serve to explain the principles of the present invention.

DETAILED DESCRIPTION OF THE PRESENT INVENTION

Figure 1:
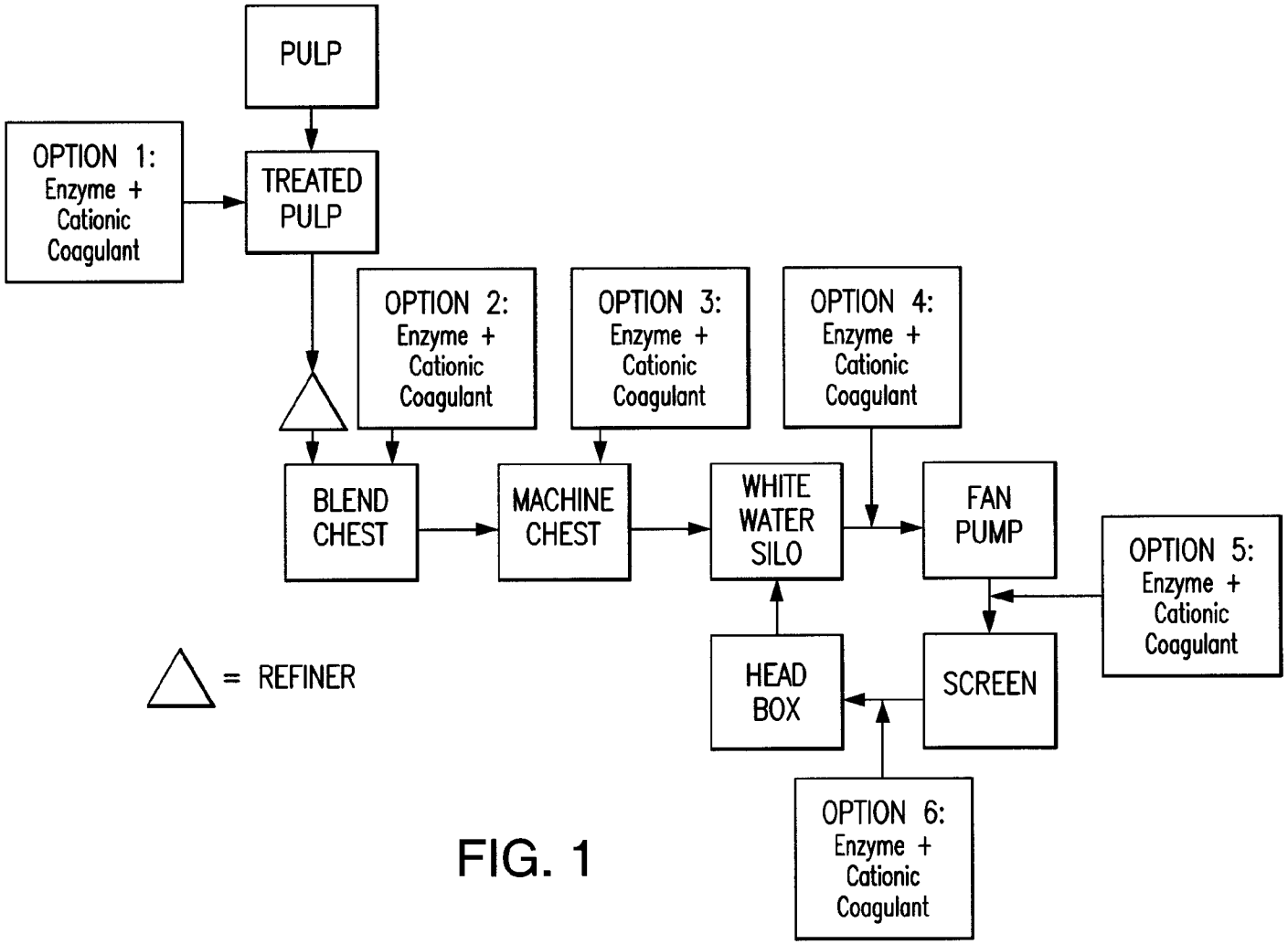
FIG. 1 is a flow chart showing a paper making method according to the present invention.

The present invention provides methods of making paper or paperboard. The enzyme(s) and cationic coagulant(s) can be applied to a paper making pulp at the same time or sequentially within a short enough period of time to permit the components to interact in combination with the pulp. The enzyme(s) and cationic coagulant(s) can be pre-combined as a pre-mixture, and then added together in a common composition to the pulp. In another option, the enzyme(s) and cationic coagulant(s) can be co-mixed in an addition pipeline or other feedline which feeds the resulting co-mixture to an introduction port(s), such as a port on a pulp processing unit. In yet another option, the enzyme composition(s) and cationic coagulant(s) can be added separately and simultaneously to the pulp from different introduction ports on the same processing unit. As another option, the enzyme composition and cationic coagulant can be introduced sequentially, i.e., separately at separate times, from the same or different introduction ports or locations on the papermaking system within a short period of time. In sequential addition, the enzyme and cationic coagulant components can be separately added in time with both components brought into contact in the pulp within a short period of time, for example, within about 5 minutes of each other, or within about 4 minutes of each other, or within about 2 minutes of each other, or within about 1 minute of each other, or within about 30 seconds of each other, or within shorter periods of time. After contacting the pulp with the enzyme(s) and cationic coagulant(s), the resulting pulp can be further processed and formed into a paper or paperboard. Sheets of pulp from which the paper or paperboard products are made can exhibit excellent drainage and/or excellent retention of pulp fines, exceeding any expectations that may be drawn from the individual effects of the enzyme and cationic coagulant components. The improvements can be synergistic. Also, these improvements in drainage and retention performance can be obtained without the need to heat the pulp to temperatures of about 40° C. or greater prior to applying the enzyme to the pulp. Flocculant(s) can be added to the pulp or pulp stream after addition of the enzyme and cationic polymer composition and before paper forming. For purposes of this patent application, the terms "pulp," "stock," and "paperstock" are used interchangeably. Also, when terms, such as enzyme or coagulant, are used in the singular, it is understood that more than one type can be used (e.g., one or more enzymes, one or more coagulants, etc.).

The method of the present invention can be practiced on conventional paper making machines with modifications that can be easily made in view of the present invention. The method of the present invention can be practiced, for example, on a wet end assembly of a conventional papermaking machine with modifications that can be easily made in view of the present invention. The method can employ many different types of paper making pulp or combinations thereof. Pulps treated on papermaking machines with the enzyme and cationic coagulant composition exhibit improved drainage performance, retention performance, or both. For example, the drainage (mass/time, e.g., g/30 sec) of pulp treated with the enzyme and cationic coagulant can be, for example, at least about 5% greater, or at least about 10% greater, or at least about 25% greater, than treatment with only one of the enzyme or the cationic coagulant (i.e., without the enzyme or without the cationic coagulant). For example, a drainage of 100 g/30 sec obtained with treatment of a pulp furnish with a composition containing either the cationic coagulant or the enzyme, but not both, can be increased by treatment with a combination of the two components (e.g., as a pre-mixture), for example, to at least about 105 g/30 sec or greater, or to at least about 110 g/30 sec or greater, or to at least about 125 g/30 sec or greater, respectively. The turbidity (NTU) of pulp, as a measure of both first and colloidal retention, treated with the enzyme and cationic coagulant can be, for example, at least about 5% less, or at least about 10% less, or at least about 25% less, than treatment with only one of the enzyme or the cationic coagulant (i.e., without the enzyme or without the cationic coagulant). In one option, the above-indicated percentage changes in drainage, turbidity, or both, can be determined relative to a value observed when only the cationic coagulant is used (i.e., without the enzyme). In another option, the above-indicated percentage changes can be determined relative to a value observed when only the enzyme is used (i.e., without the cationic coagulant). It also has been found that the combined use of the enzyme with cationic coagulant allows for enzyme accumulation in white water recirculation or other closure recirculation in papermaking methods for reducing overall enzyme addition requirements, while remaining sufficient for performing desired enzymatic reactions with the fiber in the papermaking method. The methods of the present invention make it feasible to eliminate pretreatments of cellulosic pulp before enzyme application. No heat treatment processing and associated heating equipment for pulp is required before the enzyme application in the methods of the present invention for obtaining bulk low consistency pulp, which can translate into significant energy and equipment savings. For example, the pulp does not need to be heated to a temperature of about 40° C. or greater, or about 45° C. or greater, or about 50° C. or greater, prior to applying the enzyme and cationic coagulant composition to the pulp in order for the enzyme to have the desired activity with respect to the fiber. Stated another way, the pulp can be maintained at a temperature or allowed to be stored at a temperature below about 40° C., or below about 35° C., or below about 33° C. (e.g., 10° C. to 39° C.), at all times prior to applying the enzyme and cationic coagulant composition to the pulp in the methods of the present invention, without impairing the ability of the enzyme to have the desired activity with respect to the pulp fiber. Further, the enzyme combination with cationic coagulant can be applied as a treatment for papermaking pulp at any convenient addition point or points in the papermaking system prior to paper forming, without requiring other changes of an existing wet-end program. Also, through the enzyme and cationic coagulant combination, the coagulant dosage can be significantly reduced while still acquiring significant improvements on pulp drainage and turbidity without increasing chemical additives cost. In addition or as an alternative to the above uses and benefits, the enzyme and cationic coagulant composition can be applied as a coagulant source for any program that requires coagulant in a papermaking process. In another option, the enzyme and cationic coagulant composition can be applied as an enzyme source for any program that requires an enzyme treatment process for various pulps.

The enzyme component of the enzyme used with a cationic coagulant to treat the pulp according to this invention can include, for example, an enzyme having cellulytic activity. For example, the enzyme can have activity that affects the hydrolysis of fiber. The enzyme can be, for example, cellulase, hemicellulase, pectinase, β-glucanase, CMCase, amylase, glucosidase, galactosidase, lipase, protease, lacase, or any combinations thereof. The cellulase enzyme can be, for example, a cellulase, such as an endo-cellulase, exo-cellulase, cellobiase, oxidative cellulase, cellulose phosphorylases, or any combinations thereof. Endo-cellulases that can be used, for example, are endoglucanase with binding domain (NOVOZYM® 476, Novozymes), endoglucanase enriched with high cellulase units (NOVOZYM® 51081, Novozymes), or combinations thereof, or other known or useful endo-cellulases. A single type of enzyme or a combination of two or more different types of enzymes can be used jointly with the cationic coagulant.

Cellulases generally are enzymes that degrade cellulose, a linear glucose polymer occurring in the cell walls of plants. Hemicellulases (e.g., xylanase, arabinase mannose) generally are involved in the hydrolysis of hemicellulose, which, like cellulose, is a polysaccharide found in plants. The pectinases generally are enzymes involved in the degradation of pectin, a carbohydrate whose main component is a sugar acid. β-glucanases are enzymes involved in the hydrolysis of β-glucans which are also similar to cellulose in that they are linear polymers of glucose. Liquid enzymatic compositions containing cellulases also are available under the names Celluclast® and Novozym® 188, which are both supplied by Novo Nordisk.

The following paragraphs provide examples of enzymes that can be used alone or in combination in the present invention. PULPZYM® product, available from Novo Nordisk, and ECOPULP® product, from Alko Biotechnology, are two examples of commercially available liquid enzymatic compositions containing xylanase-based bleaching enzymes.

As a class, hemicellulases can include hemicellulase mixture and galactomannanase. Commercial liquid enzymatic compositions containing hemicellulases are available as PULPZYM® from Novo, ECOPULP® from Alko Biotechnology and Novozym® 280 and Gamanase™, which are both products of Novo Nordisk.

Pectinases consist of endopolygalacturonase, exopolygalacturonase, endopectate lyase (transeliminase), exopectate lyase (transeliminase), and endopectin lyase (transeliminase). Commercial liquid enzymatic compositions containing pectinases are available under the names Pectinex™ Ultra SP and Pectinex™*, both supplied by Novo Nordisk.

β-glucanases are comprised of lichenase, laminarinase, and exoglucanase. Commercial liquid enzymatic compositions containing β-glucanases are available under the names Novozym® 234, Cereflo®, BAN, Finizym®, and Ceremix®, all of which are supplied by Novo Nordisk.

Two additional classes of industrially and commercially useful enzymes are lipases and phospholipases. Lipases and phospholipases are esterase enzymes.

Novo Nordisk markets two liquid enzyme preparations under the names Resinase™ A and Resinase™ A 2X.

Alkaline lipases can be used. Commercial liquid enzymatic compositions containing lipases are available under the names Lipolase 100, Greasex 50L, Palatase™ A, Palatase™ M, and Nipozyme™, which are all supplied by Novo Nordisk.

With respect to the commercially useful phospholipases, pancreatic phospholipase $A_2$ can be used. Isomerases can be used.

Redox enzymes can be used. Redox enzymes can include peroxidase, superoxide dismutase, alcohol oxidase, polyphenol oxidase, xanthine oxidase, sulfhydryl oxidase, hydroxylases, cholesterol oxidase, laccase, alcohol dehydrogenase, or steroid dehydrogenases.

As indicated, in one option, the enzyme and cationic coagulant components can be premixed into a common composition used to treat a pulp. An enzyme preformulated in a liquid composition can be used as the source of the enzyme combined with the cationic coagulant component. A cellulytic enzyme composition can contain, for example, from about 5% by weight to about 20% by weight enzyme. These enzyme compositions can further contain, for example, polyethylene glycol, hexylene glycol, polyvinylpyrrolidone, tetrahydrofuryl alcohol, glycerine, water, and other conventional enzyme composition additives, as for example, described in U.S. Pat. No. 5,356,800, which is incorporated herein in its entirety by reference.

Other suitable enzymes and enzyme-containing compositions include those such as described in U.S. Pat. No. 5,356,800, U.S. Pat. No. 4,923,565, and International Patent Application Publication No. WO 99/43780, all incorporated herein in their entireties by reference. Other exemplary paper making pulp-treating enzymes are BUZYME® 2523 and BUZYME® 2524, both available from Buckman Laboratories International, Inc., Memphis, Tenn.

The enzyme can be added to the pulp in an amount, for example, of from about 0.01% by weight to about 10% by weight enzyme based on the dry weight of the pulp, or from about 0.05% by weight to about 5% by weight, or from about 0.1 by weight to about 2.5% by weight, or from about 0.2 by weight to about 1.5% by weight enzyme based on dry weight of the pulp, though other amounts can be used. These addition amounts of the enzyme relative to pulp can apply to use of pre-mixtures of the enzyme and cationic coagulant in a common composition, and also the other addition options indicated herein for introducing the enzyme and cationic coagulant separately to pulp (simultaneously or sequentially). Any amount, percentage, or proportion of enzyme described herein can be on an active enzyme basis. For example, an enzyme amount referred to as 1% by weight enzyme can refer to 1% by weight active enzyme.

The cationic coagulant component can be or include a cationic organic polymer coagulant, an inorganic cationic coagulant, or combinations thereof. In addition to the synergistic affects with the enzyme, the cationic coagulant can reduce the negative surface charges present on particles in the paperstock, particularly, the surface charges of the cellulosic fines and mineral fillers, and thereby can accomplish some degree of agglomeration of such particles.

Cationic organic polymer coagulants can be, for example, cationic starch(es), polyamine, polyamidoamine-glycol, polyvinylamine (PVAm), polyethylene imine, polydiallyldimethylammonium chloride (Poly-DADMAC), glyoxalated cationic polyacrylamide, copolymer of vinylamine and acrylamide, or any combinations thereof. The cationic coagulant can be or include polyacrylamide(s). The cationic coagulant can be considered, for purposes of the present invention, to be a coagulant and/or act as a flocculant. The cationic coagulant can be synthetic, natural, or a combination thereof.

The cationic organic polymer coagulant can be a water-soluble, low molecular weight, highly charged cationic polymer. The molecular weight (number average $M_w$) of the cationic organic polymer coagulant can be, for example, from about 1,000 to about 25,000,000, or from about 2,000 to about 1,000,000, or from about 5,000 to about 750,000, or from about 10,000 to 500,000, or from about 2,000,000 to 20,000,000, or from about 5,000,000 to 15,000,000, or from about 10,000,000 to 20,000,000. Cationic polyvinylamines can include those described in U.S. Pat. No. 4,421,602 and U.S. Patent Application Publication No. 2009/0314446 A1, both of which are incorporated herein in their entireties by reference. The cationic organic polymers can be or include, for example, the following commercially available polymers: BUFLOC® 5031, a low molecular weight cationic polyamine having a 100% charge density and a molecular weight in the range of from about 100,000 to about 300,000; BUFLOC® 5551, a cationic polyvinylamine having a 100% charge density and a molecular weight in the range of from about 2000 to about 4000; and BUFLOC® 597, a cationic modified polyethylene imine having a 100% charge density and a molecular weight in the range of from about 2,000,000 to about 3,000,000, all available from Buckman Laboratories International, Inc. (Memphis Tenn.). For purposes herein, molecular weights are determined based on intrinsic viscosity as the analytic technique.

The amount of cationic organic polymer used as the cationic coagulant may vary depending on the specific chemical used, and generally can be added to the pulp in an amount, for example, of from about 0.5 pound cationic organic polymer per ton paperstock, based on dried solids of the pulp, or in an amount from about 0.5 pound to about 8 pounds per ton of paperstock, or from about 1 pound to about 6 pounds per ton of paperstock, or from about 1.5 pounds to about 4 pounds per ton of paperstock, or from about 2 pounds to about 3 pounds cationic organic polymer per ton of paperstock, based on the dried solids of the pulp, though other amounts can be used. These addition amounts of the cationic organic coagulant relative to pulp can apply to use of pre-mixtures of the enzyme and cationic organic coagulant in a common composition, and also the other addition options indicated herein for introducing the enzyme and cationic coagulant separately to pulp.

Cationic coagulants can be or include inorganic cationic chemicals (e.g., aluminum sulfate (alum), aluminum chloride, ferric chloride, ferric sulfate), cationic inorganic polymers (e.g., polyaluminum chloride (PAC) polyaluminum sulfate (PAS), polyaluminum sulfate silicate (PASS)), water-dispersible cationic mineral particles (e.g., cationic alumina mineral particles, a cationic colloidal silica sol), aluminum chlorohydrate (ACH), or any combinations thereof.

PAC can be used in the form of a very low molecular weight cationic charged dipolymer, such as those available from Buckman Laboratories International, Inc., as BUFLOC® 5041 or BUFLOC® 569. The cationic microparticle can be a cationic natural or synthetic hectorite, bentonite, zeolite, alumina sol, or any combinations thereof. Exemplary cationic mineral particles for use in the enzyme and coagulant compositions of the present invention can include the fibrous cationic colloidal alumina microparticles such as described in U.S. Pat. No. 6,770,170 B2, the fibrous alumina products obtainable by the processes described in U.S. Pat. No. 2,915,475 to Bugosh, and those described in WO 97/41063, all of which are incorporated herein in their entireties by reference.

The amount of inorganic cationic coagulant may vary depending on the specific chemical or mineral used, and generally can be added to the pulp in an amount, for example, of at least about 0.1 pound per ton of paperstock, based on dry solids of the pulp, or from about 0.2 pound per ton of paperstock to about 5.0 pounds per ton of paperstock, or from about 0.3 pound per ton of paperstock to about 4.0 pounds per ton of paperstock, or from about 0.5 pound to about 3.0 pounds per ton of paperstock, or from about 1.0 pound to about 2.0 pounds per ton of paperstock, based on dry solids of the pulp, though other amounts can be used. These addition amounts of the inorganic cationic coagulant relative to pulp can apply to use of pre-mixtures of the inorganic cationic coagulant and an enzyme in a common composition, and also the other addition options indicated herein for introducing the enzyme and cationic coagulant separately to pulp.

As several illustrations, the cationic coagulant used in combination with the enzyme can include at least one or any combination of: 1) a single type of cationic organic polymer (e.g., polyamine); 2) blends or mixtures of different cationic organic polymers in combination (e.g., a polyamine and poly-DADMAC combination; 3) a cationic organic polymer and cationic inorganic chemical coagulant blend (e.g., a polyamine and PAC combination); 4) a cationic inorganic polymer or cationic inorganic chemical or cationic mineral particles, or any combination thereof. As an option, the coagulant(s) used in the coagulant and enzyme composition is an organic polymer which has cationic charge functionalities representing, for example, at least 1%, at least 10%, at least 25%, at least 50%, at least 75%, at least 90%, or at least 95%, or at least 99%, or up to 100%, of the total ionic charge bearing functionalities of the polymer. In another option, the coagulant can be a multifunctional organic polymer having both cationic and anionic charged functionalities. In an option, the coagulant can be an organic polymer which has a net cationic charge if multifunctional. In another option, the enzyme and cationic coagulant composition can further include at least one anionic coagulant compound (such as an anionic organic polymer, an inorganic anionic compound, or both) as a separately introduced component from the cationic coagulant compound or compounds in the composition. Anionic components may cause deposits (e.g., gels) in the pulp or white water. Any amounts of anionic components, anionic functionalities on components, or both, present in the coagulant and enzyme composition can be controlled, for example, to reduce or avoid formation of such deposits and to amounts that do not impair the pulp drainage and retention performance of cationic coagulant and enzyme composition. As an option, a pre-mixture or co-mixture of the coagulant and enzyme composition can be used free or substantially free of any anionic components that cause gel deposits, impair the pulp drainage/retention performance of the composition, or both.

As indicated, in an option, the enzyme and cationic coagulant composition and components thereof can be introduced into the papermaking process at the same time to form a pre-treated pulp. As also indicated, the enzyme and cationic coagulant can be introduced to a pulp or pulp stream in the papermaking system at the same time as a pre-mixed composition. As options, the enzyme and cationic coagulant can be introduced as separate additions that blend together during or after addition into the pulp. As an indicated option, for example, the enzyme and cationic coagulant can be added separately and simultaneously to the pulp from different introduction ports on the same processing unit within the papermaking system. As another indicated option, the enzyme composition and cationic coagulant can be introduced sequentially (e.g., at separate, nonoverlapping addition times) from the same or different introduction ports or locations on the papermaking system or processing unit(s) thereof, wherein the enzyme and cationic coagulant can contact the pulp fiber to be treated within a short period of time, for example, within about 5 minutes of each other, or within about 4 minutes of each other, or within about 2 minutes of each other, or within about 1 minute of each other, or within about 30 seconds of each other, or within 10 seconds of each other, or within 5 seconds of each other, or within 3 seconds of each other, or within 2 seconds of each other, or within 1 second of each other, or within 0.5 seconds of each other, or within 0.25 seconds of each other, or within about 0.25 seconds to about 5 minutes of each other, or within about 1 minute to about 5 minutes of each other, or within about 2 to about 5 minutes of each other, or within about 2 minutes to about 4 minutes of each other.

The enzyme and cationic coagulant compositions based on pre-mixtures of these components can have, for example, from about 1% by weight to about 99% by weight enzyme and from about 99% by weight to about 1% by weight cationic coagulant, or from about 1% by weight to about 25% by weight enzyme and from about 99% by weight to about 75% by weight cationic coagulant, or from about 2.5% to about 20% by weight enzyme and from about 97.5% to about 80% by weight cationic coagulant, or from about 5% to about 15% by weight enzyme and from about 95% to about 85% by weight cationic coagulant, on a dry solids weight basis. When prepared as a pre-mixture, the composition based on the enzyme and cationic coagulant components can be formulated by sequentially or simultaneously combining the components in a fluid medium, such as water. The order of addition of the components is not limited. The various ingredients that form the enzyme and coagulant compositions of the present invention can be mixed together using conventional mixing techniques, such as a mixer, blender, stirrer, and/or an open vessel. Before and/or following aqueous dispersion of the enzyme and cationic coagulant, the pH of the resulting combination generally can be controlled, for example, to a defined level of a pH of from about 3 to about 10, or a pH of from about 4 to about 10, or a pH of from about 7.0 to about 10.0, and more suitably from about 8.0 to about 9.0. These pH ranges can apply to the composition and/or to the composition in an aqueous solution. Adjustment of pH of the composition can be accomplished, for example, through the addition of either sodium hydroxide or ammonium hydroxide (aqueous ammonia). The enzyme and cationic coagulant composition may include one or more additives, such as dyes, pigments, defoamers, biocides, pH adjusting agents, and/or cationic starch, and/or other conventional paper making or processing additives. The optional additives, if used, should not impair the unique combined effects of the enzyme and cationic coagulant, such as with respect to drainage and/or retention enhancements. As indicated, anionic components, for example, may cause deposits (gels) in the pulp or white water. The enzyme and cationic coagulant composition can contain, for example, less than about 3% by weight, or less than 2% by weight, or less than 1% by weight, or less than 0.5% by weight, of anionic components that cause deposits or gels. The enzyme and cationic coagulant composition, as a pre-mixture, can be prepared as a physically stable aqueous dispersion, which can be more stable, for example, at from about 10% by weight to about 60% by weight total solids, or from about 25% to about 50% by weight total solids, or from about 35% by weight total solids. At about 45% by weight total solids, the viscosity can tend to stay in a pourable range. Higher solids levels may tend to gradually thicken during any storage before use.

The enzyme and cationic coagulant compositions, when prepared as pre-mixtures of these components, can be prepared as masterbatches for dilution at a later time or the desirable concentration can be made at the same time that the composition is prepared. The enzyme and cationic coagulant composition can be prepared on-site or off-site or parts or components of the composition can be prepared or pre-mixed off-site or on-site prior to the ultimate formation of the composition. The compositions comprising the pre-mixtures of enzyme and cationic coagulant can be formed immediately prior to their introduction into the papermaking process or sheet making process, or the compositions can be prepared beforehand, such as before use, minutes before use, hours before use, or days or weeks or months before use, and preferably within about 2-3 weeks of usage. For instance, when the compositions are introduced as a pre-mixture of enzyme and cationic coagulant, the pre-mixture can be made about 1 to about 100 seconds before their introduction into the papermaking process, or from about 1 hour to about 5 hours, or from about 1 hour to about 10 hours, or about 1 hour to about 24 hours before use, or from about 1 day to about 7 days, or about 1 day to about 30 days, or about 1 day to about 60 days, or about 1 day to about 180 days, before use.

As indicated, the pulp or stock can be treated with the composition including both the enzyme and cationic coagulant as a pre-mixture at any location in the papermaking system before formation of the paperweb on the wire, e.g., an addition point prior to the headbox in the system. The separate additions of these components to the pulp according to other indicated options also can be done at any of these locations in the papermaking system.

The enzyme and cationic coagulant composition comprising a pre-mixture of these components can be added to paperstock, for example, in an amount of at least about 0.5 pound per ton of paperstock, based on dried solids of the pulp, or at least about 1 pound per ton of paperstock, or from about 0.5 to about 10 pounds per ton of paperstock, or from about 0.75 to about 7.5 pounds per ton of paperstock, or from about 1 to about 5 pounds per ton of paperstock, or from about 1.25 to about 4 pounds per ton of paperstock, or from about 1.5 to about 3 pounds per ton of paperstock, or from about 0.5 to about 1.5 pounds per ton of paperstock, based on dried solids of the pulp in the paperstock, though other amounts can be used. Where separate additions of the enzyme and cationic coagulant to the pulp are used according to other indicated options herein, the combined amounts of these components relative to the pulp also can be within one or more of these above-indicated ranges.

A flocculant can be added before or after addition of the enzyme and cationic coagulants to the paperstock, and typically is added after addition. The flocculant can be added, for example, after addition of the composition and/or various shear steps of any refining process applied to the treated pulp. The flocculant can be, for example, a cationic, anionic, nonionic, zwitterionic, or amphoteric polymer flocculant which can further increase retention and/or drainage in a papermaking furnish to the performance enhancements provided by the enzyme and cationic coagulant composition.

Suitable flocculants generally can have molecular weights (average MW), for example, in excess of about 1,000,000, or in excess of about 5,000,000, or in excess of about 20,000,000, or in excess of about 1,000,000 up to about 25,000,000. One polymeric flocculent can be prepared by vinyl addition polymerization of one or more cationic, anionic, or nonionic monomers; by copolymerization of one or more cationic monomers with one or more nonionic monomers; by copolymerization of one or more anionic monomers with one or more nonionic monomers; by copolymerization of one or more cationic monomers with one or more anionic monomers and optionally one or more nonionic monomers to produce an amphoteric polymer; or by polymerization of one or more zwitterionic monomers and optionally one or more nonionic monomers to form a zwitterionic polymer. One or more zwitterionic monomers and optionally one or more nonionic monomers may also be copolymerized with one or more anionic or cationic monomers to impart cationic or anionic charge to the zwitterionic polymer.

The flocculant can be used in solid form, as an aqueous solution, as a water-in-oil emulsion, or as dispersion in water. Representative cationic polymers include, for example, copolymers and terpolymers of (meth)acrylamide with dimethylaminoethyl methacrylate (DMAEM); dimethylaminoethyl acrylate (DMAEA); diethylaminoethyl acrylate (DEAEA); diethylaminoethyl methacrylate (DEAEM); or their quaternary ammonium forms made with dimethyl sulfate, methyl chloride, or benzyl chloride. The flocculant can include, for example, dimethylaminoethylacrylate methyl chloride quaternary salt-acrylamide copolymers and sodium acrylate-acrylamide copolymers and hydrolyzed polyacrylamide polymers. The flocculant can be a polyacrylamide(s).

The flocculant can be added, for example, in an amount of at least about 0.001 pound flocculant per ton of paperstock, based on dried solids of the pulp, or from about 0.01 to about 10 pounds per ton of paperstock, or from about 0.1 to about 6 pounds per ton of paperstock, or from about 0.5 to about 4 pounds flocculant per ton of paperstock, or from about 1 to about 3 pounds flocculant per ton of paperstock, based on the dried solids of the pulp in the paper furnish, though other amounts can be used.

The enzyme and cationic coagulant, as part of a single pre-mixed composition or as separate components, can be added to many different types of papermaking pulp, stock, or combinations of pulps or stocks. For example, the pulp may comprise virgin pulp and/or recycled pulp, such as virgin sulfite pulp, broke pulp, kraft pulp, soda pulp, thermomechanical pulp (TMP), alkaline peroxide mechanical pulp (APMP), chemithermomechanical pulp (CTMP), chemimechanical pulp (CMP), groundwood pulp (GP), mixtures of such pulps, and the like. The kraft pulp can be, for example, a hardwood kraft pulp, a softwood kraft pulp, or combinations thereof. The recycled pulp can be or include waste paper, OCC, and other used paper products and materials. For example, there are a variety of mechanical pulping methods to which this invention can be applied. For example, thermomechanical pulp (TMP) uses a combination of heated wood chips and mechanical processes. Stone Groundwood (SGW) grinds or macerates the wood chips. Chemithermomechanical pulp (CTMP) uses a variety of chemicals, heat, and grinding techniques to produce pulp. Different types of pulp require different types of paper although many papers can use a combination or "blend" of several different types of pulp and recycled/recovered paper. The papermaking pulp or stock can contain cellulose fibers in an aqueous medium at a concentration, for example, of at least about 50% by weight of the total dried solids content in the pulp or stock, though other concentrations may be used. These pulp formulations can be referred to as fiber furnishes.

The pulps or stocks of the present invention may be treated with one or more optional additives within the papermaking system. These optional additives may include, e.g., polymers such as cationic, anionic and/or non-ionic polymers, clays, other fillers, dyes, pigments, defoamers, pH adjusting agents such as alum, sodium aluminate, and/or inorganic acids, such as sulfuric acid, microbiocides, supplemental water retention aids such as cationic colloidal alumina microparticles, supplemental coagulants, supplemental flocculants, leveling agents, lubricants, defoamers, wetting agents, optical brighteners, pigment-dispersing agents, cross-linkers, viscosity modifiers or thickeners, or any combinations thereof, and/or other conventional and non-conventional papermaking or processing additives. For example, the pH of the (treated) pulp generally, but not exclusively, can be controlled to a defined level of from about 4.0 to about 8.5, and more suitably from about 4.5 to about 8.0.

The pulps or stocks of the present invention may additionally be treated with one or more other components, including polymers such as anionic and non-ionic polymers, clays, other fillers, dyes, pigments, defoamers, pH adjusting agents such as alum, microbiocides, microparticles (e.g., ACH), and other conventional papermaking or processing additives. These additives can be added before, during, or after introduction of the enzyme and cationic coagulant composition.

The methods of the present invention can be practiced on any pulp related applications, including, for example, where pulps are treated and dewatered. The methods can be practiced, for example, on conventional paper making machines (such as a Fourdrinier type paper machine), for example, on wet end assemblies of paper making machines, with modifications that can be made in view of the present invention. A flow chart of a paper making system for carrying out one of the methods of the present invention is set forth in FIG. 1. FIG. 2 further shows optional addition points for flocculant. It is to be understood that the system shown is exemplary of the present invention and is in no way intended to restrict the scope of the invention.

Figure 2:
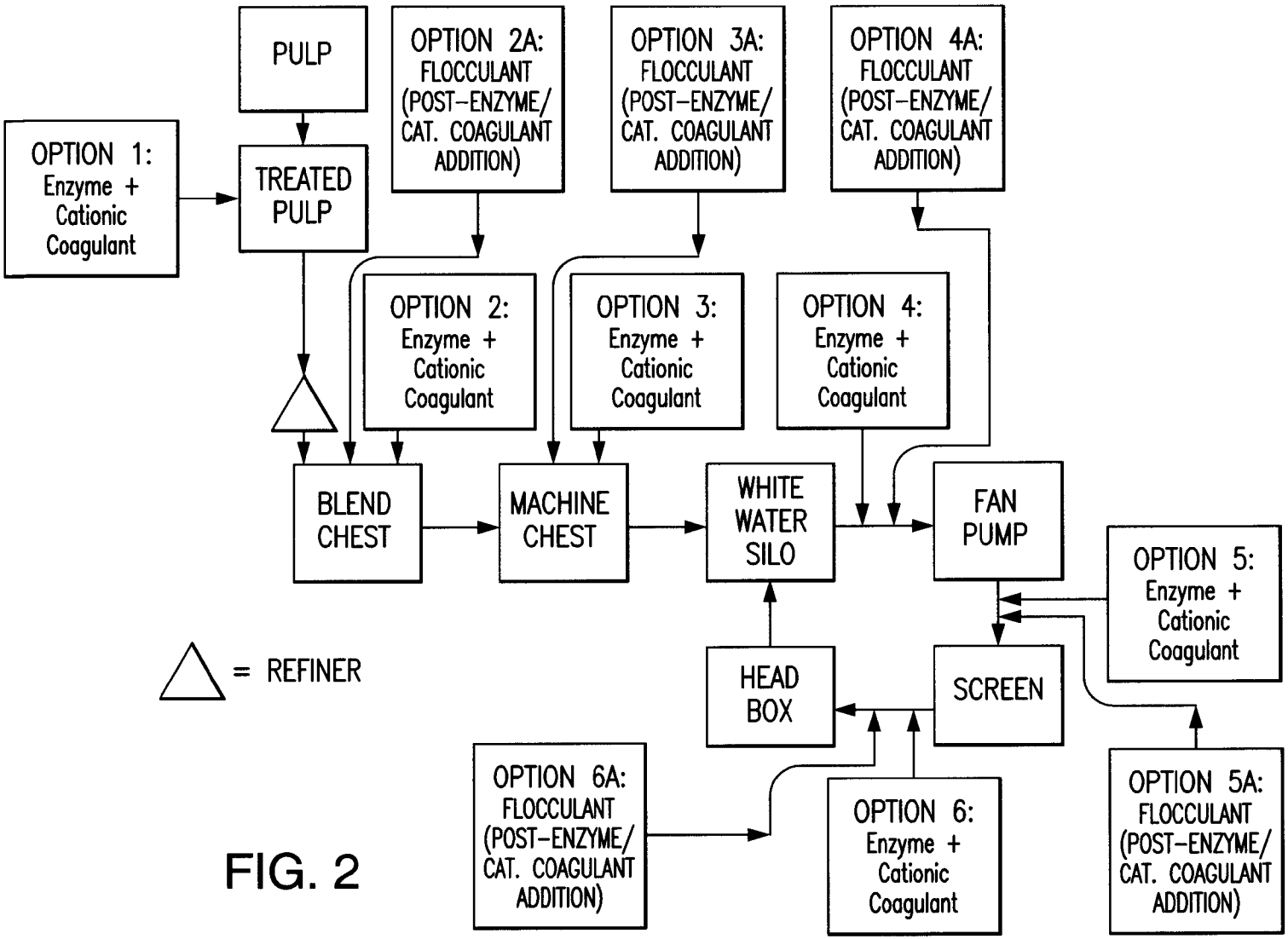
FIG. 2 is a flow chart showing a paper making method according to the present invention.

In the system of FIG. 1, an enzyme and cationic coagulant composition at a desired concentration is combined with a flowing stream of papermaking pulp to form a treated pulp at one or more of the addition point Options 1-6 shown in FIG. 1. To simplify this illustration (and the illustration of FIG. 2), an enzyme and cationic coagulant composition is shown added to the system as a pre-mixture of the enzyme and cationic coagulant. These and/or other addition points for the enzyme and cationic coagulant composition may be used as long as the composition is introduced before paper forming at the head box. The system can include a metering device for providing a suitable amount of the enzyme and cationic coagulant composition to the flow of pulp. Other metering or dosing devices also can be provided for the other additives and ingredients that may be used during the method.

A flocculant can be added before or after introduction of the enzyme and coagulant composition, such as in one or more of additive introduction Options 2A-6A shown in FIG. 2, and before the head box. For example, when the enzyme and cationic coagulant composition is added at Option 1, the flocculant could be added at any of the addition points shown as Options 2A-6A in FIG. 2. When the enzyme and cationic coagulant composition is added at Option 2, the flocculant could be added at any of Options 3A-6A, and so forth. The supply of enzyme and cationic coagulant composition can be, for example, a holding tank having an outlet in communication with an inlet of a tank or line in the system. The supply of flocculant can be, for example, a holding tank having an outlet in communication with a tank or line in the system. Other optional additives may be added at other points along the flow of pulp or treated pulp through the system shown in FIG. 1, such as at one or more of addition location Options 1-6. Conventional valving and pumps used in connection with introducing the compositions and additives can be used.

In FIG. 1, the supply of pulp shown represents a flow of pulp, as for example, supplied from a pulp holding tank or silo. The supply of pulp shown in FIG. 1 can be a conduit, holding tank, or mixing tank, or other container, passageway, or mixing zone for the flow of pulp. The pulp is passed from the pulp tank through a refiner and then through a blend chest where necessary compositions and/or optional additives of the process may be combined with the pulp. The refiner has an inlet in communication with an outlet of the treated pulp tank, and an outlet in communication with an inlet of the blend chest. According to the embodiment of FIG. 1, the pulp in the blend chest is passed from an outlet of the blend chest through a communication to an inlet of a machine chest where optional additives also may be combined with the treated pulp. The blend chest and machine chest can be of any conventional type known to those skilled in the art. The machine chest ensures a level head, that is, a constant pressure on the treated pulp or stock throughout the downstream portion of the system, particularly at the head box. From the machine chest, the pulp is passed to a white water silo and then to a fan pump, and then the pulp is passed through a screen. The screen can be sized, for example, so as to allow water containing undesirable or unusable components of the white water (e.g., fines, ash) to pass through the screen while retaining usable fibers on the screen that can be incorporated into the fibrous material supplied to the headbox. The screened pulp passes to a head box where a wet papersheet is formed on a wire and drained. The wire section can include equipment, for example, which is conventionally used and can be easily adapted for use in methods of the present invention. Pulp collected as a wet web on the forming wire can be further processed, for example, such as one or more of further drained, pressed, dried, calendered, or other processing such as typically used in a papermaking machine, before it may be conveyed to a winder, and it can be further conveyed to either paper sheeting or can be conveyed to coating and conversion stations (not shown). In the system of FIG. 1, drained pulp resulting from papermaking in the headbox is recirculated to the white water silo. The pulps or stocks also may be treated with one or more other optional additives introduced at addition points 1-6 or other locations within the system.

As shown in FIG. 1, for pulp treatment, the enzyme and cationic coagulant composition can be added prior to the head box after the screen, or added prior to the screen, or added prior to the fan pump, or added prior to the whitewater silo, or added prior to the machine chest, or added prior to the blend chest, or added prior to the first refiner in a paper making process, or any combinations of these addition locations. It can be useful to add the enzyme and cationic coagulant, at least in part, far enough upstream of the head box to allow the enzyme and cationic coagulant components sufficient time and opportunity to interact with the pulp without requiring any preheating of the pulp (e.g., heated temperatures of about 40° C. or greater) before treatment with the composition. Process temperatures in the papermaking system are not limited, and can be, for example, from about 15° C. to about 70° C., or from about 30° C. to about 60° C., or from about 15° C. to about 35° C., or from about 20° C. to about 34° C., or from about 25° C. to 33° C., or about 32° C., though other temperatures can be used. As an option, the pulp temperatures of the treated pulp during at least substantially (e.g., at least about 90% up to 100%) the entire time of contact of the enzyme and cationic coagulant composition with the pulp in the papermaking system can be maintained at from about 30° C. to about 60° C. and the time of contact can be from about 1 minute to about 150 minutes or other times. Other treatment temperatures and times with respect to the pulp treated with the enzyme and cationic coagulant composition can be, for example, from about 30° C. to about 50° C. and the time of contact can be from about 2 minutes to about 100 minutes, or from about 32° C. to about 40° C. and the time of contact can be from about 5 minutes to about 60 minutes, or other temperature and time combinations.

A pulp or stock treated with the composition including both the enzyme and cationic coagulant can exhibit good dewatering during formation of the paperweb on the wire. The pulp or stock also can exhibit a desirable high retention of fiber fines and fillers in the paperweb products. The addition of flocculant, or microparticles, or both, to the treated pulp can impart further improvements and enhancements, for example, such as with respect to dewatering and retention performance. Although illustrated for papermaking processing, the use of the enzyme and cationic coagulant combination also can relate to its application for other cellulosic fiber contained material for enhanced dewatering in waste water treatments and other industries.

The present invention includes the following aspects/embodiments/features in any order and/or in any combination:

1. The present invention relates to a method of making paper or paperboard comprising:

a) applying a composition comprising enzyme and cationic coagulant to a paper making pulp to form a treated pulp; and b) forming the treated pulp into paper or paperboard.

2. The method of any preceding or following embodiment/feature/aspect, wherein the pulp is kept at a temperature or temperatures below about 40° C. prior to applying the composition to the pulp.

3. The method of any preceding or following embodiment/feature/aspect, wherein the composition comprises from about 1% by weight to about 99% weight enzyme and from about 99% by weight to about 1% by weight cationic coagulant, on a dry solids weight basis.

4. The method of any preceding or following embodiment/feature/aspect, wherein the enzyme is a cellulytic enzyme.

5. The method of any preceding or following embodiment/feature/aspect, wherein the enzyme is cellulase, hemicellulase, pectinase, β-glucanases, CMCase, amylase, glucosidase, galactosidase, lipase, protease, lacase, or any combinations thereof.

6. The method of any preceding or following embodiment/feature/aspect, wherein the enzyme is endoglucanase.

7. The method of any preceding or following embodiment/feature/aspect, wherein the cationic coagulant is a cationic organic polymer coagulant.

8. The method of any preceding or following embodiment/feature/aspect, wherein the cationic coagulant is a polyamine, polyacrylamide, polyamidoamine-glycol, polyvinylamine, polyethylene imine, polydiallyldimethylammonium chloride, glyoxalated cationic polyacrylamide, cationic starch, or any combinations thereof.

9. The method of any preceding or following embodiment/feature/aspect, wherein the cationic coagulant is a polyamine, polyamidoamine-glycol, polyvinylamine, polyethylene imine, or any combinations thereof.

10. The method of any preceding or following embodiment/feature/aspect, wherein the cationic coagulant is an inorganic cationic coagulant.

11. The method of any preceding or following embodiment/feature/aspect, wherein the cationic coagulant is polyaluminum chloride, aluminum sulfate, water-dispersible alumina mineral particles, aluminum sulfate, aluminum chloride, ferric chloride, ferric sulfate, polyaluminum sulfate, polyaluminum sulfate silicate, cationic alumina mineral particles, a cationic colloidal silica sol, aluminum chlorohydrate, or any combinations thereof.

12. The method of any preceding or following embodiment/feature/aspect, wherein the composition is added to the pulp in an amount of at least about 0.5 pound per ton based on the dried solids weight of the pulp.

13. The method of any preceding or following embodiment/feature/aspect, further comprising applying a flocculant to the pulp after applying the composition to the pulp and prior to paper forming.

14. The method of any preceding or following embodiment/feature/aspect, wherein pulp temperatures of the treated pulp during at least substantially an entire time of contact of the composition with the pulp is maintained at from about 30° C. to about 60° C. and the time of contact is from about 1 minute to about 150 minutes.

15. The method of any preceding or following embodiment/feature/aspect, wherein the flocculant is added to the pulp in an amount of at least about 0.01 pound per ton based on the dried solids weights of the pulp.

16. The method of any preceding or following embodiment/feature/aspect, wherein the drainage (g/50 sec) is at least about 5% greater than treatment of the pulp without the enzyme.

17. The method of any preceding or following embodiment/feature/aspect, wherein the turbidity (NTU) is at least about 5% less than treatment of the pulp without the enzyme.

18. A papermaking system comprising a supply of papermaking pulp, a processing unit for forming the pulp into a paper or paperboard comprising a screen for collecting pulp and a paper sheet forming processing unit receiving pulp from the screen, a supply of a composition comprising an aqueous dispersion of enzyme and cationic coagulant and a composition feeding device for feeding the composition to the pulp for application thereto prior to paper forming, and a supply of flocculant and a flocculant feeding device for feeding the flocculant to the treated pulp downstream from where the enzyme and cationic coagulant composition is applied to the pulp, and a white water silo for white water recirculation.

19. The system of any preceding or following embodiment/feature/aspect, wherein said processing unit for forming the pulp comprises a blend chest in communication with said supply of pulp, a fan pump in communication with the blend chest, the screen in communication with said fan pump, and a head box as the paper forming processing unit in communication with said screen.

20. The system of any preceding or following embodiment/feature/aspect, wherein said white water silo has a first inlet in communication with said machine chest, a second inlet in communication with said head box, and an outlet in communication with said fan pump.

The present invention can include any combination of these various features or embodiments above and/or below as set forth in sentences and/or paragraphs. Any combination of disclosed features herein is considered part of the present invention and no limitation is intended with respect to combinable features.

The present invention will be further clarified by the following examples, which are intended to be purely exemplary of the present invention, in which parts and percentages are proportions by weight unless otherwise specified.

EXAMPLES

Example 1

The drainage and retention properties of compositions exemplifying the present invention were examined.

Experimental

The following materials and protocols were used for the experiments.

Pulp Furnish:

Refined OCC pulps and white water were obtained from linerboard manufacturers, such as Sonoco, Richmond, Va. and International Paper, Valliant Okla., as CSF 220, CSF 410, and as CSF 330. Newsprint furnish and white water were obtained from a Newsprint paper manufacturer, such as Catalyst, Snowflake, Ariz., as CSF 50.

Chemicals and Dosages:

Cationic coagulant used for the experiments was a low molecular weight cationic polyamine (BUFLOC® 5031, Buckman Laboratories International, Inc.), and a typical dosage was 1.5 lb/ton (dry solids basis) for OCC furnish and 4.0 lb/ton (dry solids basis) for Newsprint. The flocculant was a polyacrylamide (BUFLOC® 5511, Buckman Laboratories International, Inc.), and was used at a typical dosage of 0.2 lb/ton (dry solids basis) for the tests. The selected enzyme was NOVOZYM® 51081 from Novozymes. Enzyme was pre-mixed with cationic coagulant before applying it to pulp at designed addition levels. Different dosages or other additives included in experiments are indicated where applicable.

Testing Procedure:

A MüTek™ RDF tester was applied for all drainage tests to measure drainage and turbidity. The testing furnish consistency was 1.0%. The chemical addition program was to add cationic coagulant first and follow with flocculant. To simulate white water circulation, the filtrate was collected after testing and reused for next testing sample. The sample temperature for all testing was controlled at 32° C.

Results

Figure 3:
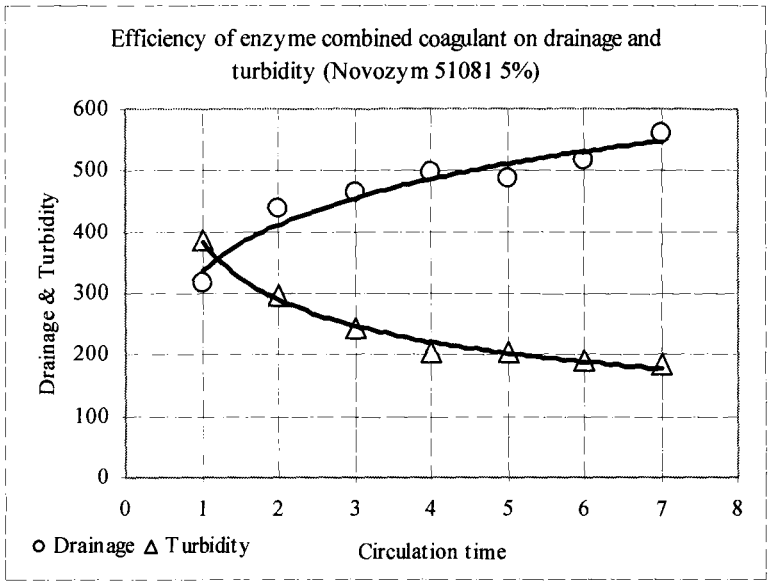
FIG. 3 shows the effects of enzyme combined with cationic coagulant on OCC furnish drainage (g/50 sec) and turbidity (NTU) at an enzyme addition level of 5% as related in Example 1.
Figure 4:
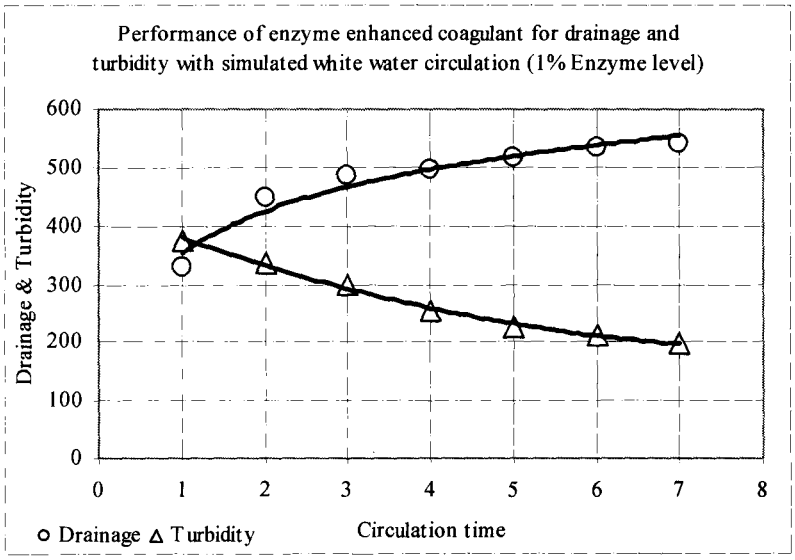
FIG. 4 shows the effects of enzyme combined with cationic coagulant on OCC furnish drainage (g/30 sec) and turbidity (NTU) at an enzyme addition level of 1% as related in Example 1.
Figure 5:
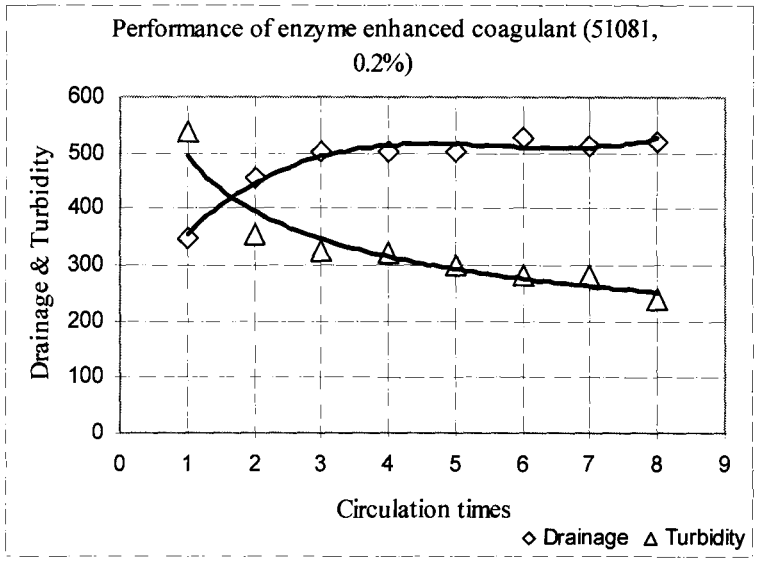
FIG. 5 shows the effects of enzyme combined with cationic coagulant on OCC furnish drainage (g/30 sec) and turbidity (NTU) at an enzyme addition level of 0.2% as related in Example 1.

Tables 1-3 shows results for the effects of enzyme combined with cationic coagulant on OCC furnish drainage and turbidity at different enzyme addition levels, 5%, 1% and 0.2% by weight, respectively. For these experiments, OCC furnish (CSF 220) was treated with the enzyme (NOVOZYM® 51081), 1.5 lb/ton coagulant (BUFLOC® 5031), and 0.2 lb/ton (dry solids basis) flocculant (BUFLOC® 5511) other than the 0.2% enzyme run, and also 1.0 lb/ton (dry solids basis) microparticle (BUFLOC® 5461) (anionic colloidal silica) was included. The results are graphically shown in FIGS. 3-5, respectively.

TABLE 1

| White water Recirculations No. | Drainage g/50 sec | Turbidity NTU |
|---|---|---|
| 1st | 317 | 386 |
| 2nd | 437 | 297 |
| 3rd | 465 | 243 |
| 4th | 498 | 206 |
| 5th | 488 | 203 |
| 6th | 517 | 190 |
| 7th | 559 | 186 |

TABLE 2

| White water Recirculations No. | Drainage g/50 sec | Turbidity NTU |
|---|---|---|
| 1st | 329 | 376 |
| 2nd | 449 | 336 |
| 3rd | 485 | 300 |
| 4th | 496 | 252 |
| 5th | 518 | 227 |
| 6th | 534 | 212 |
| 7th | 541 | 198 |

TABLE 3

| White water Recirculations No. | Drainage g/50 sec | Turbidity NTU |
|---|---|---|
| 1st | 348 | 539 |
| 2nd | 457 | 353 |
| 3rd | 501 | 326 |
| 4th | 501 | 322 |
| 5th | 502 | 299 |
| 6th | 526 | 281 |
| 7th | 515 | 281 |

TABLE 3-continued

| White water Recirculations No. | Drainage g/50 sec | Turbidity NTU |
|---|---|---|
| 8th | 521 | 240 |

Figure 6:
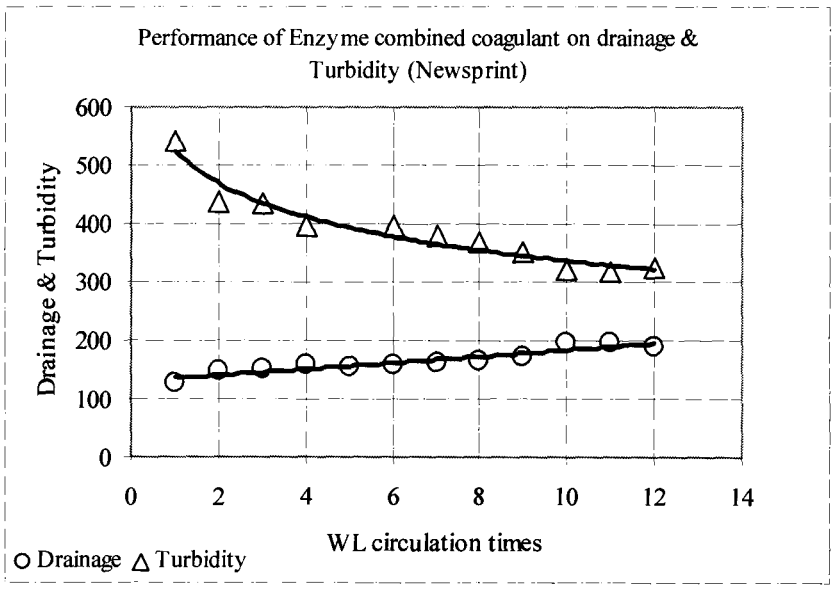
FIG. 6 shows the effects of enzyme combined with cationic coagulant on Newsprint furnish drainage (g/30 sec) and turbidity (NTU) at 1% enzyme addition level as related in Example 1.

Table 4 shows the results for the effects of enzyme combined with cationic coagulant on Newsprint furnish drainage and turbidity at 1% by weight enzyme addition level. For this experiment, Newsprint (CSF 50) was treated with 1% by weight enzyme (NOVOZYM® 51081), 4.0 lb/ton (dry solids basis) coagulant (BUFLOC® 5031), and 0.2 lb/ton (dry solids basis) flocculant (BUFLOC® 5511). The results are graphically shown in FIG. 6.

TABLE 4

| White water Recirculations No. | Drainage g/30 sec | Turbidity NTU |
|---|---|---|
| 1st | 128 | 543 |
| 2nd | 147 | 439 |
| 3rd | 151 | 436 |
| 4th | 158 | 397 |
| 5th | 155 | |
| 6th | 159 | 396 |
| 7th | 163 | 380 |
| 8th | 167 | 368 |
| 9th | 173 | 353 |
| 10th | 195 | 319 |
| 11th | 195 | 316 |
| 12th | 190 | 324 |

Figure 7:
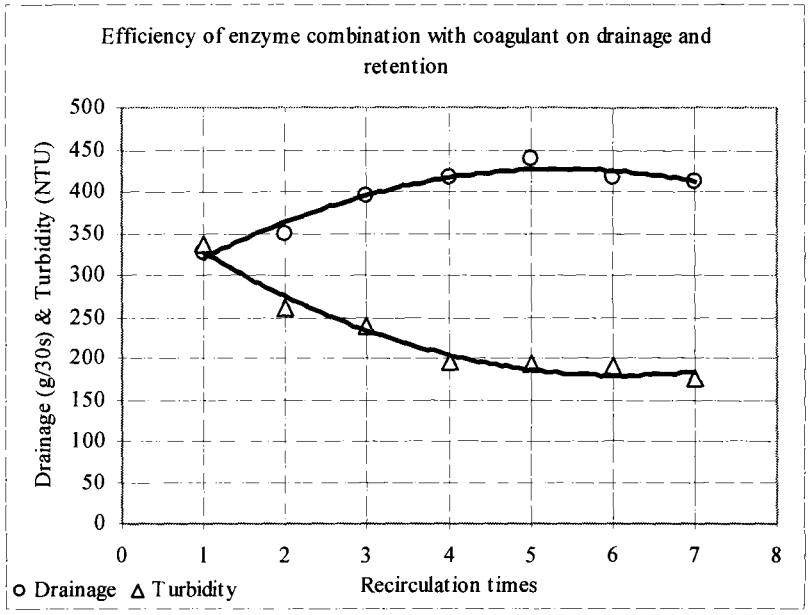
FIG. 7 shows the effects of enzyme combined with cationic coagulant on OCC furnish drainage (g/30 sec) and turbidity (NTU) at the equal cost to the regular coagulant without enzyme addition as related in Example 1.

Table 5 shows results for the effects of enzyme combined with cationic coagulant on OCC furnish drainage and turbidity at 1% by weight enzyme addition level at the equal cost to the regular coagulant without enzyme addition. For this experiment, OCC furnish (CSF 410) was treated with 1% by weight enzyme (NOVOZYM® 51081), 2.0 lb/ton (dry solids basis) coagulant (BUFLOC® 5031), and 0.2 lb/ton (dry solids basis) flocculant (BUFLOC® 5511). The results are graphically shown in FIG. 7.

TABLE 5

| White water Recirculations No. | Drainage g/30 sec | Turbidity NTU |
|---|---|---|
| 1st | 328 | 336 |
| 2nd | 350 | 260 |
| 3rd | 396 | 238 |
| 4th | 418 | 196 |
| 5th | 438 | 192 |
| 6th | 418 | 190 |
| 7th | 412 | 175 |

Figure 8:
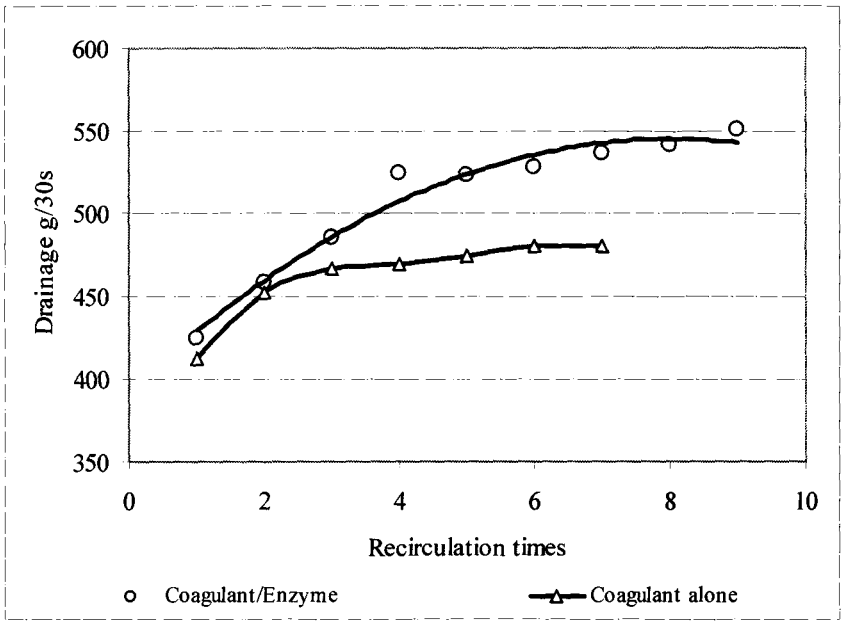
FIG. 8 compares the furnish drainage (g/30 sec) of cationic coagulant in white water recirculation with an enzyme and cationic coagulant combination and without the combination as related in Example 1.
Figure 9:
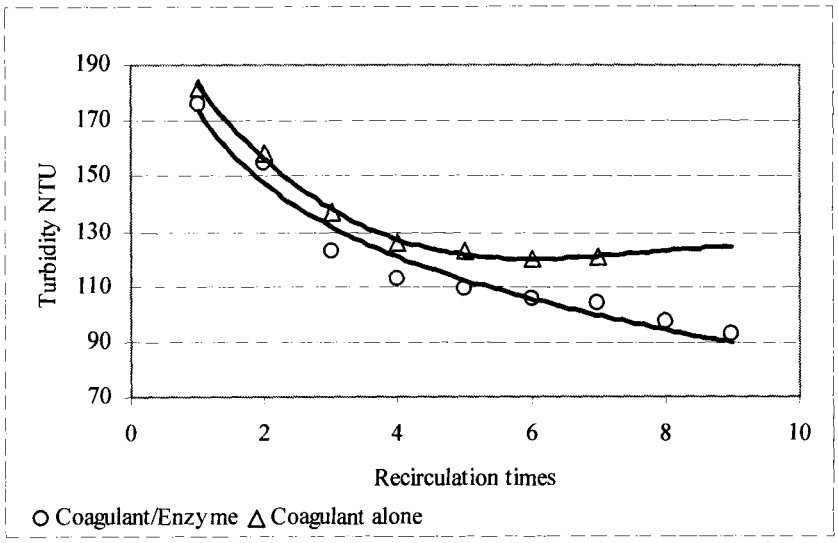
FIG. 9 compares the furnish turbidity (NTU) of cationic coagulant in white water recirculation with an enzyme and cationic coagulant combination and without enzyme combination as related in Example 1.

Table 6 shows the results for the effects of enzyme combined with cationic coagulant, and cationic coagulant without enzyme, on OCC furnish drainage and turbidity in white water recirculation. For this experiment, OCC furnish (CSF 410) was treated with 1% by weight enzyme (NOVOZYM® 51081) or no enzyme, 1.5 lb/ton (dry solids basis) coagulant (BUFLOC® 5031), and 0.2 lb/ton (dry solids basis) flocculant (BUFLOC® 5511). The results are graphically shown in FIGS. 8 and 9.

TABLE 6

| White water | Drainage g/30 sec | | Turbidity NTU | |
|---|---|---|---|---|
| Recirculations No. | Enzyme combined | No enzyme | Enzyme combined | No enzyme |
| 1st | 425 | 412 | 176 | 182 |
| 2nd | 459 | 452 | 155 | 158 |
| 3rd | 485 | 467 | 123 | 137 |
| 4th | 524 | 469 | 113 | 126 |
| 5th | 523 | 474 | 109 | 123 |
| 6th | 528 | 480 | 105 | 120 |
| 7th | 536 | 481 | 104 | 121 |

Example 2

The drainage and retention properties of additional compositions exemplifying the present invention were examined.

Experimental

The following materials and protocols were used for the experiments.

Pulp Furnish:

Refined OCC pulp was obtained from a linerboard manufacturer, such as Sonoco, Richmond, Va., as CSF 220.

Chemicals and Dosages:

Cationic coagulant used for the experiments was BUFLOC® 5031 (Buckman Laboratories International, Inc.), and the dosage was 1.5 lb/ton (dry solids basis) for OCC furnish. The flocculant was BUFLOC® 5511 (Buckman Laboratories International, Inc.), and was used at a dosage of 0.2 lb/ton (dry solids basis) for the tests. The selected enzyme was NOVOZYM® 51081 from Novozymes at a dosage of about 1 wt %. Enzyme was premixed with cationic coagulant before applying it to pulp at designed addition levels.

Testing Procedure:

The testing procedure used was similar to that used in Example 1.

Results

Figure 10:
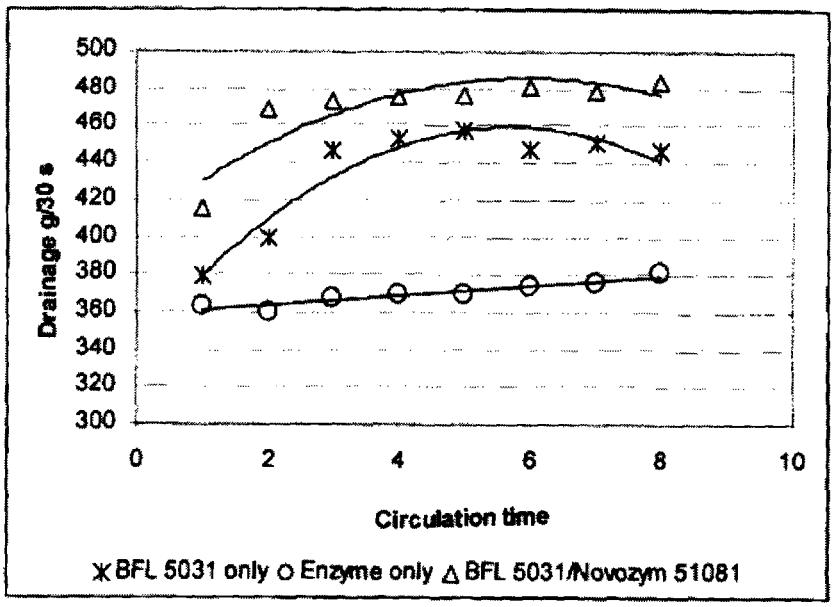
FIG. 10 compares the furnish drainage (g/30 sec) of cationic coagulant in white water recirculation with an enzyme and cationic coagulant combination, cationic coagulant without enzyme combination, and enzyme without cationic coagulant combination, as related in Example 2.
Figure 11:
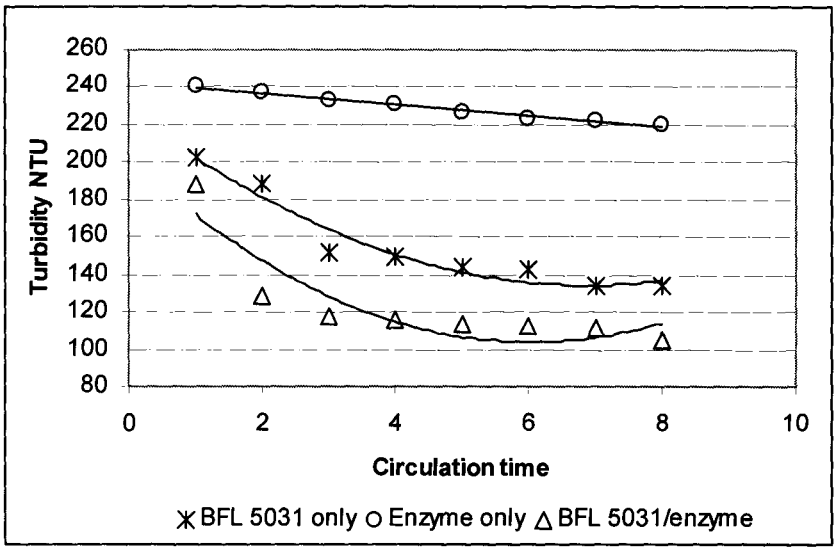
FIG. 11 compares the furnish turbidity (NTU) of cationic coagulant in white water recirculation with an enzyme and cationic coagulant combination, cationic coagulant without enzyme combination, and enzyme without cationic coagulant combination, as related in Example 2.

Table 7 shows results for the effects of enzyme combined with cationic coagulant, and cationic coagulant without enzyme combination, and enzyme without cationic coagulant combination, on OCC furnish drainage and turbidity. The results are graphically shown in FIGS. 10 and 11, respectively. The results show that drainage was greater and turbidity was lower for OCC furnish treated with enzyme combined with cationic coagulant at all circulation times as compared to furnish treated with cationic coagulant without enzyme combination and furnish treated with enzyme without cationic coagulant combination.

Example 3

The drainage and retention properties of additional compositions exemplifying the present invention were examined.

Experimental

The following materials and protocols were used for the experiments.

Pulp Furnish:

Refined OCC pulp was obtained from a linerboard manufacturer, such as Sonoco, Richmond, Va., as CSF 220.

Chemicals and Dosages:

Cationic coagulants used for the experiments were low molecular cationic polyamine (BUFLOC® 5031, Buckman Laboratories International, Inc.), polyamidoamine-glycol (BUFLOC® 597, Buckman Laboratories International), and low molecular weight cationic polyamine (BUFLOC® 5551, Buckman Laboratories International, Inc.). The coagulant dosage was 1.5 lb/ton (dry solids basis). The flocculant was a polyacrylamide (BUFLOC® 5511, Buckman Laboratories International, Inc.), and was used at dosage of 0.2 lb/ton (dry solids basis) for all tests. The selected enzyme was NOVOZYM® 51081 from Novozymes. Enzyme was premixed with coagulant before applying to pulp at designed addition levels. The microparticle used was BUFLOC® 5461, Buckman Laboratories International, Inc., at a dosage of 1.0 lb/ton (dry solids basis).

Testing Procedure:

An $L_9(3^4)$ Orthogonal Experimental Design was applied for this experimentation. This experimental design strategy is shown, for example, in Hinkelmann, K., et al., (2008), *Design and Analysis of Experiments*. I and II (Second ed.), Wiley, ISBN 978-0-470-38551-7, and Ghosh, S., et al., (1996), *Design and Analysis of Experiments*. Handbook of Statistics, 13, North-Holland, ISBN 0-444-82061-2. Selected variables and ranges are listed in Table 8. Experimental results and analysis for both drainage and turbidity are summarized in Table 9-10.

A MüTek™ RDF tester was applied for all drainage tests to measure drainage and turbidity. The testing furnish consistency was 1.0%. The chemical addition program was to add coagulant first and follow with flocculant. To simulate white water circulation, the filtrate was collected after testing and reused for next testing sample. The sample temperature for testing was controlled as indicated.

TABLE 7

| | Drainage (g/30s) | | | Turbidity (NTU) | | |
|---|---|---|---|---|---|---|
| Circulations | Cationic Coagulant only | Enzyme only | Cationic Coagulant/Enzyme | Cat. Coagulant only | Enzyme only | Cationic Coagulant/Enzyme |
| 1 | 379 | 363 | 415 | 203 | 241 | 188 |
| 2 | 399 | 360 | 469 | 188 | 237 | 129 |
| 3 | 446 | 367 | 473 | 152 | 233 | 118 |
| 4 | 453 | 370 | 475 | 149 | 231 | 116 |
| 5 | 457 | 370 | 477 | 144 | 226 | 114 |
| 6 | 448 | 374 | 481 | 143 | 223 | 112 |
| 7 | 451 | 376 | 479 | 134 | 222 | 111 |
| 8 | 446 | 381 | 484 | 134 | 220 | 105 |

TABLE 8

| Variables and level | | | |
|---|---|---|---|
| Variables & Levels | I | II | III |
| Enzyme content in coagulant, wt % | 5 | 10 | 15 |
| Contact time, min | 0 | 20 | 40 |
| Temperature, ° C. | 20 | 40 | 60 |
| Coagulant type | BUFLOC ® 5031 | BUFLOC ® 597 | BUFLOC ® 5551 |

TABLE 9

Experimental design and analysis for drainage

| | Factor | | | | |
|---|---|---|---|---|---|
| No. | Enzyme content (wt %) | Time (min) | Temp (° C.) | Coagulant | Drainage (g/50 sec) |
| 1 | I | I | I | I | 296 |
| 2 | I | II | II | II | 323 |
| 3 | I | III | III | III | 387 |
| 4 | II | I | II | III | 319 |
| 5 | II | II | III | I | 382 |
| 6 | II | III | I | II | 299 |
| 7 | III | I | III | II | 352 |
| 8 | III | II | I | III | 307 |
| 9 | III | III | II | I | 357 |
| $K_1$ | 1006 | 967 | 902 | 1035 | |
| $K_2$ | 1000 | 1012 | 999 | 974 | |
| $K_3$ | 1016 | 1043 | 1121 | 1013 | |
| $k_1$ | 335.3 | 322.3 | 300.7 | 345.0 | |
| $k_2$ | 333.3 | 337.3 | 333.0 | 324.7 | |
| $k_3$ | 338.7 | 347.7 | 373.7 | 337.7 | |
| R | 5.3 | 25.3 | 73.0 | 20.3 | |

Statistics analysis of the orthogonal experimental design was targeted to clarify the significance levels of the influence of all process factors on drainage performance. The $K_i$ was sum of drainage at level (i). The $k_i$ value for each level of a parameter was the average of four values shown in Table 9, and the range value (R) for each factor was the difference between the maximal and minimal value of the three levels. Based on the results of range analysis, the importance of the contributions of the studied factors to drainage is therefore ranked as follows: Temperature>Time>Coagulant type>Enzyme dosage. The similar analysis for turbidity is shown in Table 10. Time and Temperature showed similar impact on turbidity, which are the most significant factors for turbidity. Enzyme type and Dosage showed less important impact.

TABLE 10

Experimental design and analysis for turbidity

| | Factor | | | | |
|---|---|---|---|---|---|
| No. | Enzyme content (wt %) | Time (min) | Temp (° C.) | Coagulant | Turbidity (NTU) |
| 1 | I | I | I | I | 483 |
| 2 | I | II | II | II | 481 |
| 3 | I | III | III | III | 466 |
| 4 | II | I | II | III | 409 |
| 5 | II | II | III | I | 524 |
| 6 | II | III | I | II | 539 |
| 7 | III | I | III | II | 436 |
| 8 | III | II | I | III | 492 |

TABLE 10-continued

Experimental design and analysis for turbidity

| | Factor | | | | |
|---|---|---|---|---|---|
| No. | Enzyme content (wt %) | Time (min) | Temp (° C.) | Coagulant | Turbidity (NTU) |
| 9 | III | III | II | I | 464 |
| $K_1$ | 1430 | 1328 | 1514 | 1471 | |
| $K_2$ | 1472 | 1497 | 1354 | 1456 | |
| $K_3$ | 1392 | 1469 | 1426 | 1367 | |
| $k_1$ | 476.7 | 442.7 | 504.7 | 490.3 | |
| $k_2$ | 490.7 | 499.0 | 451.3 | 485.3 | |
| $k_3$ | 464.0 | 489.7 | 475.3 | 455.7 | |
| R | 26.7 | 56.3 | 53.3 | 34.7 | |

Figure 12:
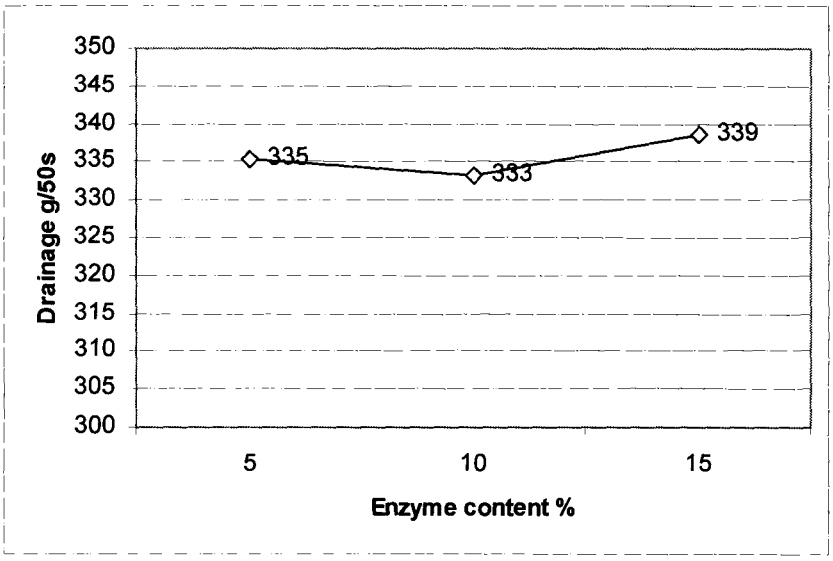
FIG. 12 shows the effects of enzyme combined with cationic coagulant on OCC furnish drainage (g/50 sec) at enzyme addition levels of 5%, 10%, and 15% as related in Example 3.
Figure 13:
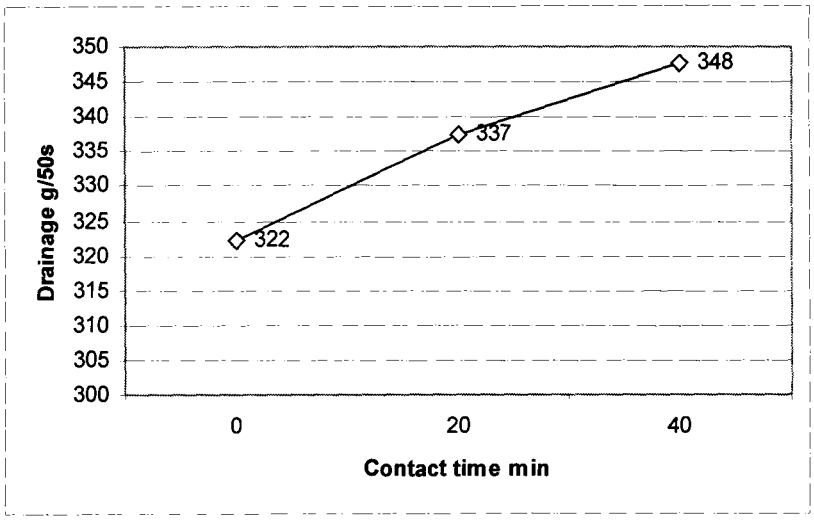
FIG. 13 shows the effects of enzyme combined with cationic coagulant on OCC furnish drainage (g/50 sec) at contact times of 0 minutes, 20 minutes, and 40 minutes as related in Example 3.
Figure 14:
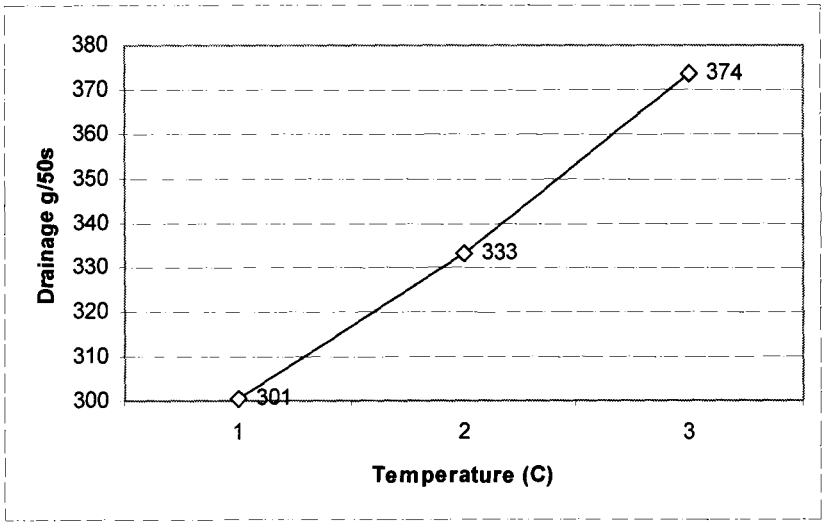
FIG. 14 shows the effects of enzyme combined with cationic coagulant on OCC furnish drainage (g/50 sec) at temperatures of 20° C., 40° C., and 60° C. as related in Example 3.
Figure 15:
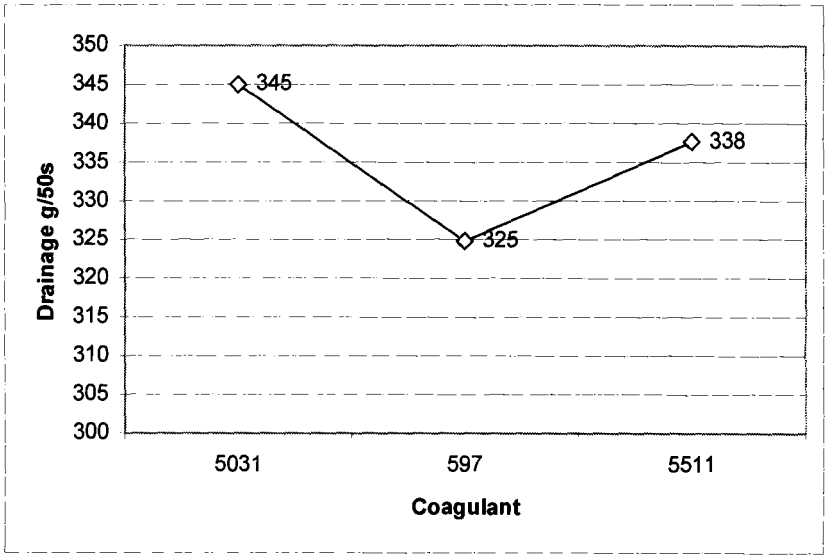
FIG. 15 shows the effects of enzyme combined with cationic coagulant on OCC furnish drainage (g/50 sec) for different coagulants of BUFLOC® 5031 and BUFLOC® 597, and flocculant of BUFLOC® 5511 as related in Example 3.
Figure 16:
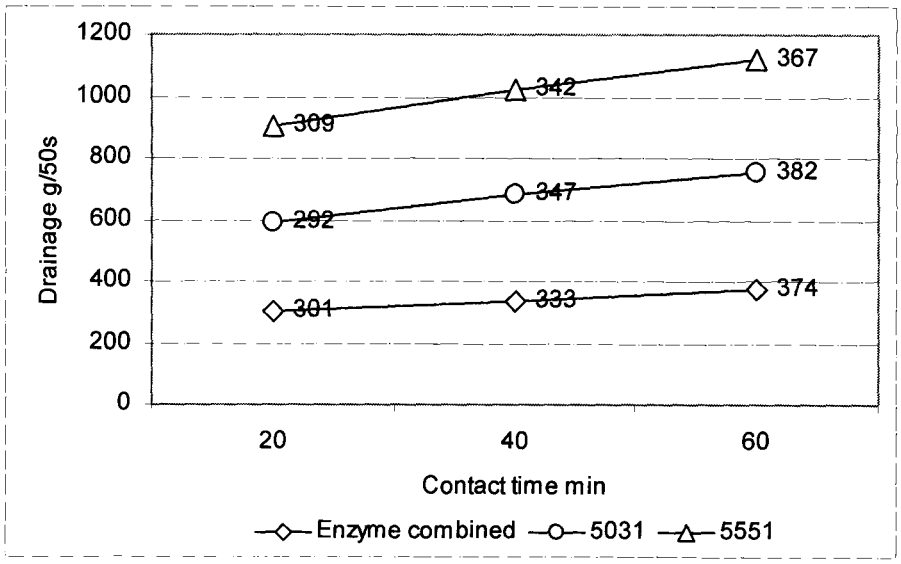
FIG. 16 shows the effects of enzyme combined with cationic coagulant, coagulant alone, and flocculant alone, on OCC furnish drainage (g/50 sec) as related in Example 3.

With respect to effect on drainage, based on range analysis, the significance of all selected variables could be ranked in importance, from more important to less, as follows: a) temperature; b) contact time and coagulant type; c) enzyme content level in coagulant. Within the experimental range used, increasing enzyme content from 5% to 10% by weight, and to 15% by weight, combined into cationic coagulant did not show significant effects on the drainage achieved at the lower enzyme content, as shown in FIG. 12. Longer contact time normally improves drainage, as FIG. 13 shows. Temperature effects furnish drainage, as shown in FIG. 14. However, it should be noted that contribution of temperature to drainage is not fully ascribed to activated enzyme, as higher temperature is believed to have effect on fluidity of pulp and water so to speed up drainage as shown in FIG. 16 in the case without enzyme added. Enzyme content in the combination of coagulant/enzyme is based on total solids of coagulant and enzyme, which means that increase in enzyme content result in reduction in coagulant content. Since enzyme addition in this experiment ranged from 5-15% on total solids in the combination of coagulant/enzyme, coagulant percentage in the combination ranged from 95-85%. The result revealed that enzyme functioned to enhance drainage only when sufficient amount of coagulant could be used. At certain coagulant dosages, higher enzyme ratio in combination led to less amount of coagulant added in pulp furnish, and resulted in lower drainage. For the experiments shown in FIG. 16, some pulps were only tested with one or the other indicated cationic coagulant (i.e., BUFLOC® 5031 or BUFLOC® 5551), but not the enzyme, and other pulps were treated with a combined enzyme and a cationic coagulant (BUFLOC® 5031). Also, the selection of cationic coagulant for combination with the enzyme demonstrated some effect on the drainage results, as indicated in FIG. 15. Among the tested coagulants, BUFLOC® 5031 showed the best effectiveness with the enzyme on drainage, and effects on drainage seen with pulps treated with BUFLOC® 5551 and BUFLOC® 597 also were considered beneficial.

Figure 17:
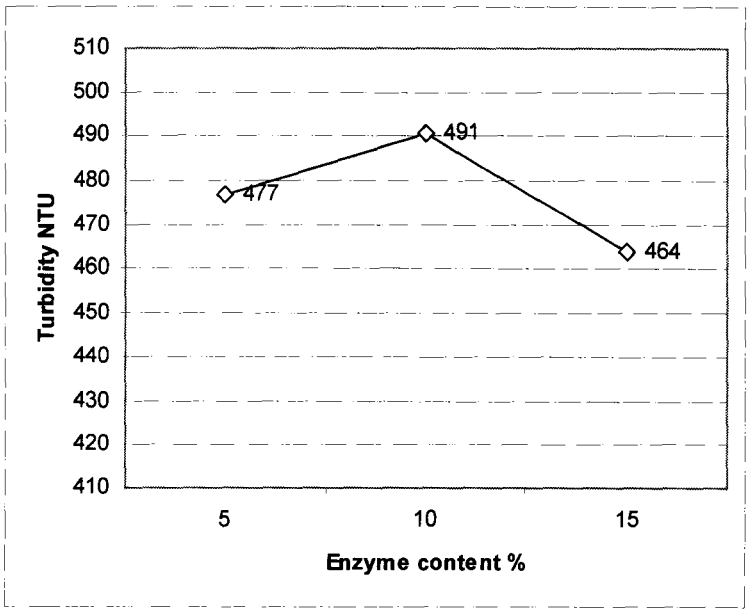
FIG. 17 shows the effects of enzyme combined with cationic coagulant on OCC furnish turbidity (NTU) at enzyme addition levels of 5%, 10%, and 15% as related in Example 3.
Figure 18:
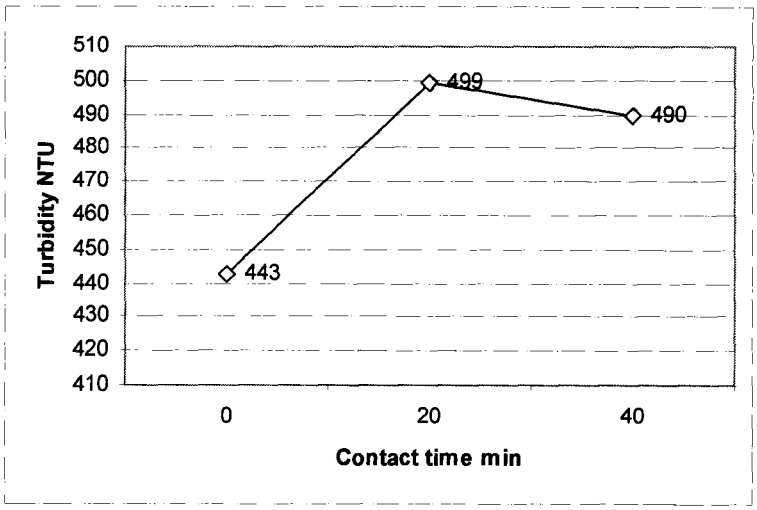
FIG. 18 shows the effects of enzyme combined with cationic coagulant on OCC furnish turbidity (NTU) at contact times of 0 minutes, 20 minutes, and 40 minutes as related in Example 3.
Figure 19:
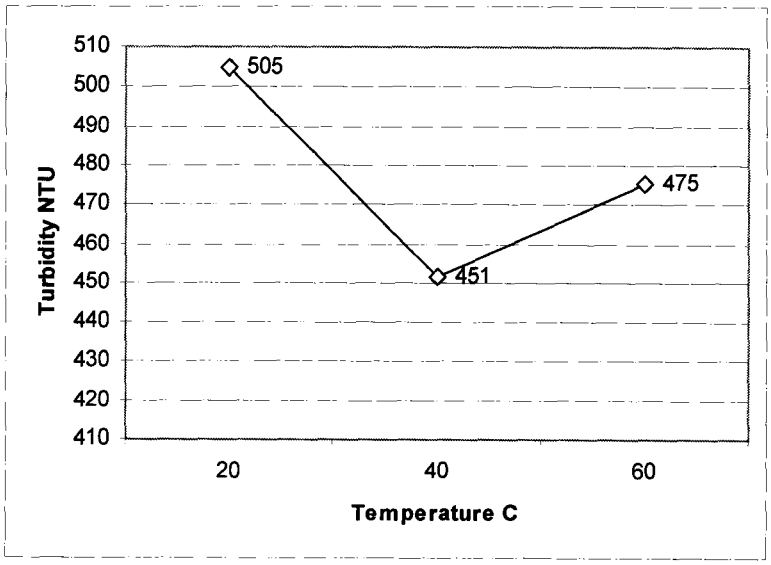
FIG. 19 shows the effects of enzyme combined with cationic coagulant on OCC furnish turbidity (NTU) at temperatures of 20° C., 40° C., and 60° C. as related in Example 3.
Figure 20:
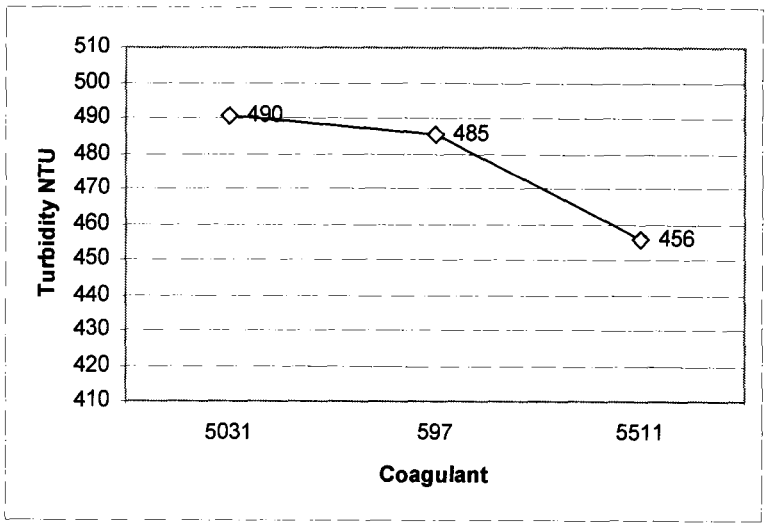
FIG. 20 shows the effects of enzyme combined with cationic coagulant on OCC furnish turbidity (NTU) for different coagulants of BUFLOC® 5031 and BUFLOC® 597, and flocculant of BUFLOC® 5511 as related in Example 3.

With respect to effects on turbidity, turbidity can be used for approximation of retention performance. Results are summarized in Table 10 and plotted in FIGS. 17-20. Both time and temperature show significant effect on turbidity, but quite different from the effect on drainage. Extending time of enzyme in contact with cellulosic fibers increases drainage but also increase turbidity, as FIG. 18 shows. Overall, higher temperature would reduce turbidity which implies the improvement on retention, as shown in FIG. 19. Cationic coagulant selection also showed effects on turbidity results. Pulps treated with BUFLOC® 5551 exhibited the lowest turbidity when combined with enzyme, and effects on turbidity seen with pulps treated with BUFLOC® 5031 and BUFLOC® 597 also were considered beneficial. Enzyme content appears to be a less significant factor as compared with others mentioned on turbidity, as FIG. 17 shows.

Figure 21:
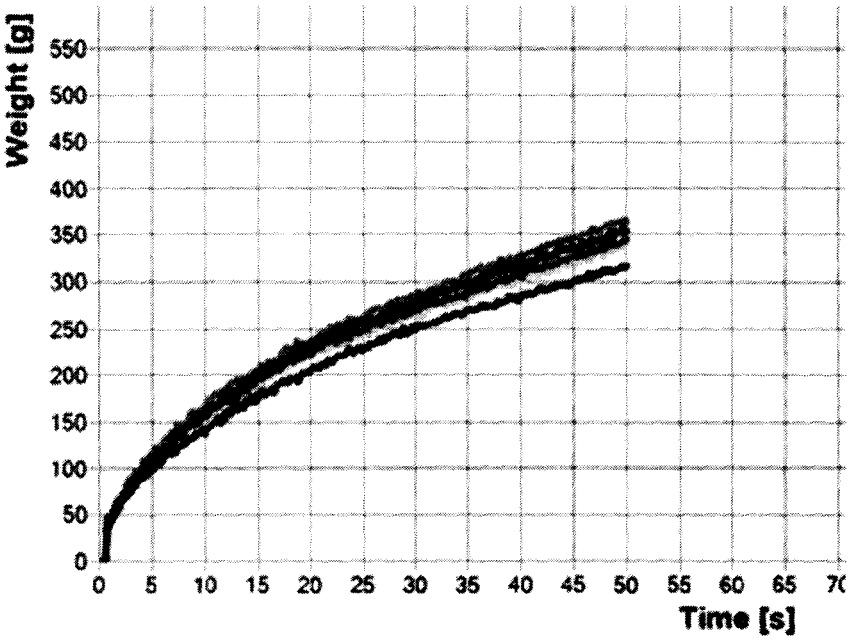
FIG. 21 shows results of a simulation of white water recirculation showing effects of enzyme on drainage (g) related to time (seconds) as related in Example 3.

With respect to simulation of white water recirculation and impact on enzyme effect, a preliminary simulation of white water circulation was run to investigate the effect of enzyme in white water circulation. The results are shown as FIG. 21. An apparent increase in drainage was observed when run as a series of tests using circulated water. These results indicate it is an efficient and feasible solution to extend contact time of enzyme with fibers, which could overcome an obstacle of enzyme application as a regular coagulant. Although not desiring to be bound to a particular theory, it is believed that the white water recirculation can allow added time for performance improvements to be more fully obtained by the enzyme and cationic coagulant composition, and may show a benefit of adding the composition later in the process.

Applicants specifically incorporate the entire contents of all cited references in this disclosure. Further, when an amount, concentration, or other value or parameter is given as either a range, preferred range, or a list of upper preferable values and lower preferable values, this is to be understood as specifically disclosing all ranges formed from any pair of any upper range limit or preferred value and any lower range limit or preferred value, regardless of whether ranges are separately disclosed. Where a range of numerical values is recited herein, unless otherwise stated, the range is intended to include the endpoints thereof, and all integers and fractions within the range. It is not intended that the scope of the invention be limited to the specific values recited when defining a range.

It will be apparent to those skilled in the art that various modifications and variations can be made to the embodiments of the present invention without departing from the spirit or scope of the present invention. Thus, it is intended that the present invention covers other modifications and variations of this invention provided they come within the scope of the appended claims and their equivalents.

What is claimed is:

1. A method of making paper or paperboard comprising:

a) applying a composition comprising enzyme and cationic coagulant to a paper making pulp to form a treated pulp, wherein said composition is added in a paper making process to the paper making pulp after a white water silo and prior to at least one of a fan pump, a screen, and a head box from which filtrate drained from pulp is recirculated to said white water silo, wherein the composition comprises from about 1% by weight to about 99% weight enzyme and from about 99% by weight to about 1% by weight cationic coagulant, on a dry solids weight basis, and the composition is added to the pulp in an amount of from 0.5 pound per ton to 10 pounds per ton based on the dried solids weight of the pulp; and b) forming the treated pulp into paper or paperboard, wherein pulp temperatures of the treated pulp during at least substantially an entire time of contact of the composition with the pulp is maintained at from about 30° C. to about 60° C. and the time of contact is from about 1 minute to about 150 minutes.

2. The method of claim 1, wherein the pulp is kept at a temperature or temperatures below about 40° C. prior to applying the composition to the pulp.

3. The method of claim 1, wherein the enzyme is a cellulytic enzyme.

4. The method of claim 1, wherein the enzyme is cellulase, hemicellulase, pectinase, β-glucanases, CMCase, amylase, glucosidase, galactosidase, lipase, protease, lacase, or any combinations thereof.

5. The method of claim 1, wherein the enzyme is endoglucanase.

6. The method of claim 1, wherein the cationic coagulant is a cationic organic polymer coagulant.

7. The method of claim 1, wherein the cationic coagulant is a polyamine, polyacrylamide, polyamidoamine-glycol, polyvinylamine, polyethylene imine, polydiallyldimethylammonium chloride, cationic starch, or any combinations thereof.

8. The method of claim 1, wherein the cationic coagulant is a polyamine, polyamidoamine-glycol, polyvinylamine, polyethylene imine, or any combinations thereof.

9. The method of claim 1, wherein the cationic coagulant is an inorganic cationic coagulant.

10. The method of claim 1, wherein the cationic coagulant is polyaluminum chloride, aluminum sulfate, water-dispersible alumina mineral particles, aluminum sulfate, aluminum chloride, ferric chloride, ferric sulfate, polyaluminum sulfate, polyaluminum sulfate silicate, cationic alumina mineral particles, a cationic colloidal silica sol, aluminum chlorohydrate, or any combinations thereof.

11. The method of claim 1, further comprising applying a flocculant to the pulp after applying the composition to the pulp and prior to paper forming.

12. The method of claim 11, wherein the flocculant is added to the pulp in an amount of at least about 0.01 pound per ton based on the dried solids weights of the pulp.

13. The method of claim 1, wherein the drainage (g/50 sec) is at least about 5% greater than treatment of the pulp without the enzyme.

14. The method of claim 1, wherein the turbidity (NTU) is at least about 5% less than treatment of the pulp without the enzyme.

15. The method of claim 1, wherein said composition is added in the paper making process to the paper making pulp after the white water silo and prior to the fan pump.

* * * * *